US005727544A

United States Patent [19]

Miura

[11] Patent Number: 5,727,544

[45] Date of Patent: Mar. 17, 1998

[54] MASK MAINTAINING WARMTH IN NASAL AREA

[75] Inventor: Masuo Miura, Hannoh, Japan

[73] Assignee: Cleantec Co., Ltd., Tokyo, Japan

[21] Appl. No.: 450,627

[22] Filed: May 25, 1995

[30] Foreign Application Priority Data

Jun. 3, 1994 [JP] Japan ..... 6-122888

[51] Int. Cl.[6] ..... A62B 18/08

[52] U.S. Cl. ..... 128/201.13; 128/206.16; 128/206.19

[58] Field of Search ..... 128/201.13, 206.16, 128/206.19, 863, 206.18

[56] References Cited

U.S. PATENT DOCUMENTS

| | | | |
|---|---|---|---|
| 628,111 | 7/1899 | McHatton | 128/206.18 |
| 958,569 | 5/1910 | Venner | 128/206.18 |
| 1,914,418 | 6/1933 | Goyena | 128/206.18 |
| 2,087,042 | 7/1937 | Phillips | 128/206.18 |
| 2,161,607 | 6/1939 | Anderson | 128/206.18 |
| 2,176,380 | 10/1939 | Schwartz . | |
| 2,295,321 | 9/1942 | Anderson | 128/206.18 |
| 2,296,775 | 9/1942 | Dockson | 128/863 |
| 2,468,383 | 4/1949 | Tiffany | 128/201.13 |
| 3,229,681 | 1/1966 | Gluckstein | 128/201.13 |
| 3,695,265 | 10/1972 | Brevik . | |
| 4,684,570 | 8/1987 | Malaney | 128/206.19 |
| 4,784,131 | 11/1988 | Schroeder | 128/206.18 |
| 4,790,307 | 12/1988 | Haber et al. | 128/206.19 |
| 4,966,140 | 10/1990 | Herzberg | 128/206.14 |
| 5,007,114 | 4/1991 | Numano | 128/201.13 |
| 5,025,506 | 6/1991 | Huang | 128/863 |

FOREIGN PATENT DOCUMENTS

| | | | |
|---|---|---|---|
| 1 354 867 | 6/1964 | France . | |
| 1 364 599 | 10/1964 | France . | |
| 2683153 | 5/1993 | France | 128/201.17 |
| 7-18545 | 12/1932 | Japan . | |
| 48-59394 | 5/1971 | Japan . | |
| 52-15893 | 7/1975 | Japan . | |
| 58-185240 | 9/1983 | Japan . | |
| 60-6547 | 1/1985 | Japan . | |
| 60-43233 | 3/1985 | Japan . | |
| WO 92/11888 | 7/1992 | WIPO . | |
| WO 92/19322 | 11/1992 | WIPO . | |

*Primary Examiner*—Aaron J. Lewis
*Attorney, Agent, or Firm*—Cushman, Darby & Cushman IP Group of Pillsbury, Madison & Sutro LLP

[57] ABSTRACT

A simple and effective mask maintaining warmth in the nasal area is disclosed for preventing, relieving, or eliminating the occurrence of the symptoms of allergic nasal inflammation due to hay fever or the like. The mask maintaining warmth in the nasal area comprises a main body in the form of a sheet, a nasal area warmth-maintenance portion for covering at least the nasal area and being provided in a central portion of said main body, and straps for attaching the mask to the face. The nasal area warmth-maintenance portion has an upper end portion protruding from the upper end of the main body, and said upper end portion covers at least the upper portion of the nasal area. The main body and the nasal area warmth-maintenance portion may be formed unitarily or separately. Allergy symptoms are relieved, eliminated, or prevented because the nasal area warmth-maintenance portion can effectively maintain or add warmth to at least the nasal area.

28 Claims, 19 Drawing Sheets

MASK MAINTAINING WARMTH IN NASAL AREA

BACKGROUND OF THE INVENTION

1. Field of the Invention

The present invention relates to a mask maintaining warmth in the nasal area which prevents the intrusion of microscopic particles such as pollen into the nasal cavity and prevents, relieves, or eliminates the occurrence of allergic reactions due to pollen and the like by maintaining warmth in the nasal area.

2. Relevant Art

Generally, the symptoms of allergic reactions to pollen and the like take the form of sneezing, running noses, nasal congestion, and inflammation of the nasal membrane. It is known that these symptoms occur when allergens such as cedar pollen, dust, mites, and exhaust fumes attach to the mucous membrane within the nasal cavity. Since enormous pain or discomfort can be inflicted on a patient if the above-mentioned symptoms occur in force, many types of countermeasures have been attempted in order to prevent or relieve these symptoms.

For example, one of the most common ways for preventing or relieving the above-mentioned symptoms is to wear a mask made from gauze in a sheet form. In this case, it is not possible to sufficiently block the intrusion of allergens with only the gauze, so masks having allergen absorbing or filtering layers made from activated carbon or ceramics are also used. These methods attempt to physically block the intrusion of allergens into the nasal cavities by covering the nose with the above-mentioned masks. In addition to these methods, medical treatment or relief such as the taking of medication which suppresses the above-mentioned symptoms or the application of liquid medication to the nasal membrane by spraying within the nasal cavity are performed.

However, with the above-mentioned methods which used masks, the effect of preventing the intrusion of allergens does not last because the central portion of the mask becomes obstructed by moisture from breathing and mucous while the mask is being worn, thereby forcing air to enter from the sides. If the holes in the mask are made larger in order to prevent such obstructions, the effect of blocking allergens is also reduced, so in practice, such methods are unreliable in preventing or relieving symptoms.

Additionally, with the method in which medication is taken, even if the symptoms are relieved during the period of effectiveness of the medication, the symptoms return when the period of effectiveness ends, so even if the medication is retaken, the symptoms remain until the medication takes effect. In order to avoid this, it is necessary to regularly take the medication at prescribed time intervals. Additionally, methods which depend upon medication are generally not preferable because there is a possibility of side-effects. With a method in which medication is applied to the nasal membrane by spraying, it is difficult to continually prevent symptoms over a long period of time since the applied medication can flow off along with mucous which is secreted by the nasal membrane. Additionally, in recent years, an immunization method called "desensitization treatment" has been suggested, but has yet to be widely accepted.

SUMMARY OF THE INVENTION

The present invention is provided in order to resolve the above-mentioned problems, and has as one of its objective the provision of a mask maintaining warmth in the nasal area which is able to simply and effectively prevent, relieve, or eliminate the occurrence of allergic reactions to pollen and the like without the fear of side-effects.

The present invention is a mask maintaining warmth in the nasal area comprising a main body in the form of a sheet, a nasal area warmth-maintenance portion provided in a central portion of the main body and covering at least the nasal area of the face when said mask is worn, and a strap for fixing the main body to the face; wherein said nasal area warmth-maintenance portion has an upper end portion covering at least the top portion of the nose and the upper end portion is provided so as to protrude from one side of the main body.

The present inventor has discovered that the symptoms of allergic nasal inflammation such as hay fever are able to be prevented, relieved, or eliminated by maintaining or adding warmth to the nasal and surrounding areas. In the mask maintaining warmth in the nasal area of the present invention, the main body blocks intrusion of microscopic allergens, such as pollen, into the nasal cavity, and the nasal area warmth-maintenance portion prevents, relieves, or eliminates the occurrence of symptoms by maintaining or adding warmth to the nasal and surrounding areas.

Additionally, because the upper end portion of the nasal area warmth-maintenance portion is provided so as to protrude from the side of the main body while the mask is worn on the face, warmth is able to be maintained or added to the top portion of the nose without the main body of the mask blocking the field of view.

FIG, 16A is a diagram showing a modification example of the mask maintaining warmth in the nasal area of the present invention as worn over the face with the ribs folded.

Figure 16A:
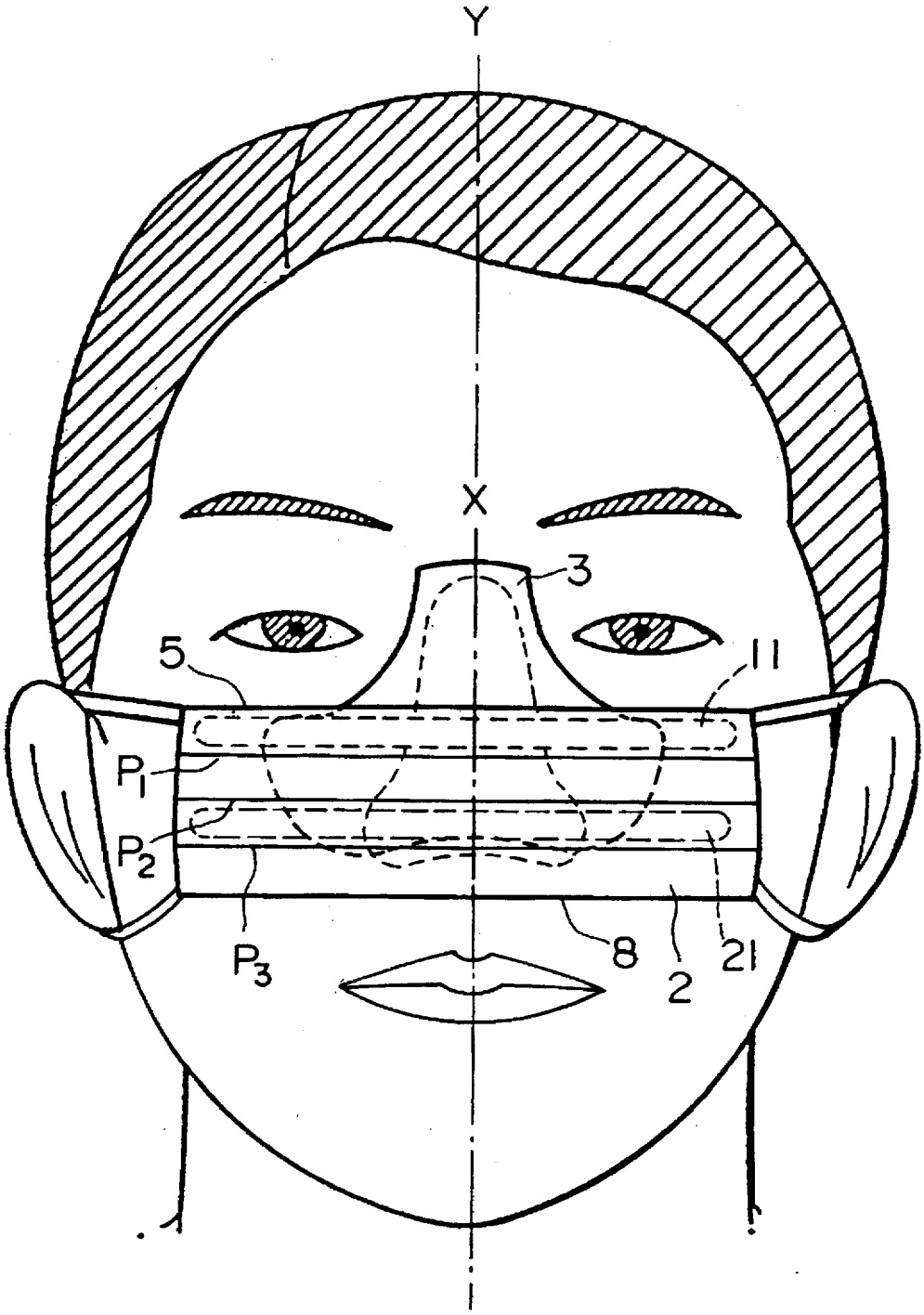
Figure 16B:
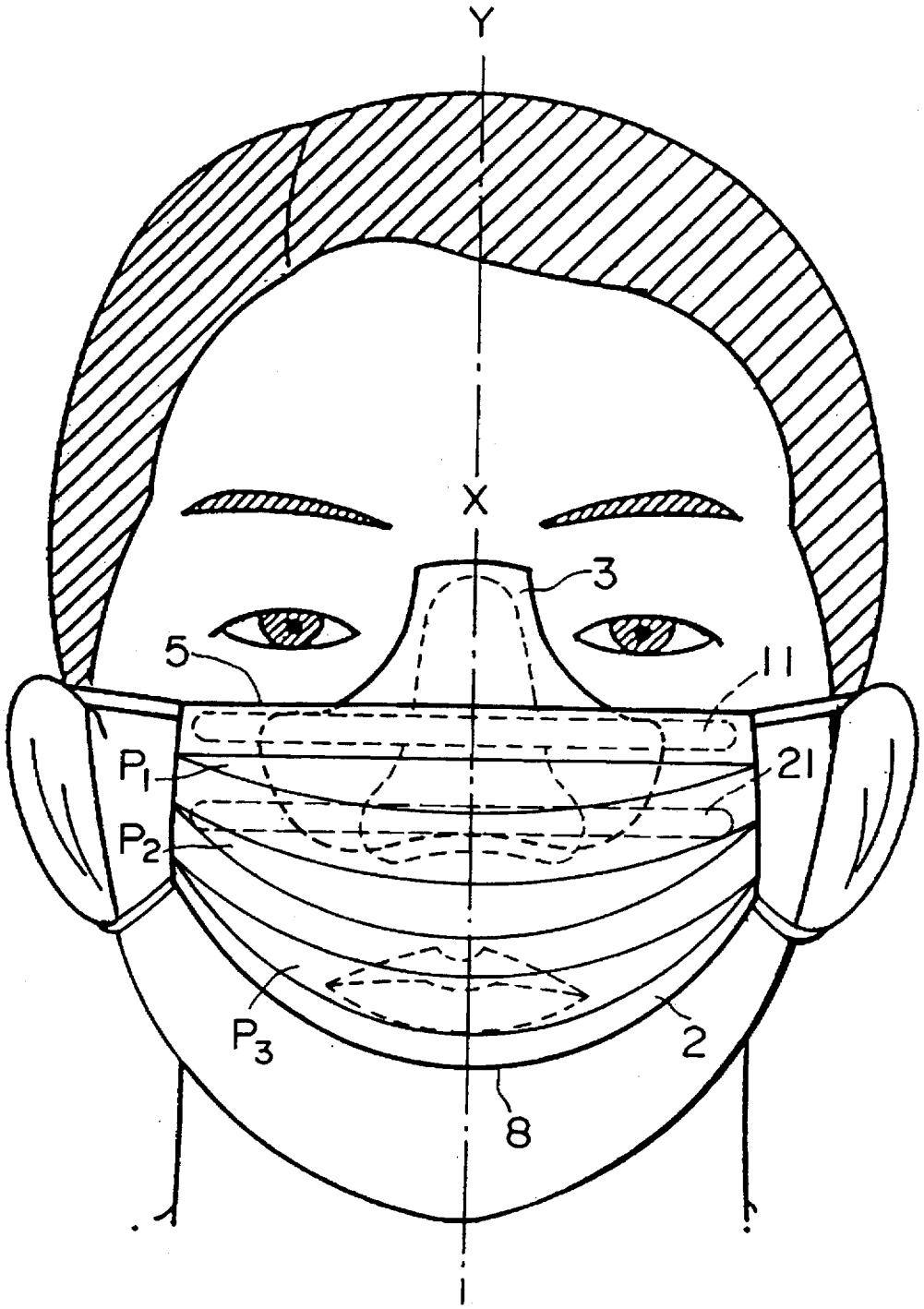

FIG. 16B is a diagram showing a modification example of the mask maintaining warmth in the nasal area of the present invention as worn over the face with the ribs spread.

Figure 17A:
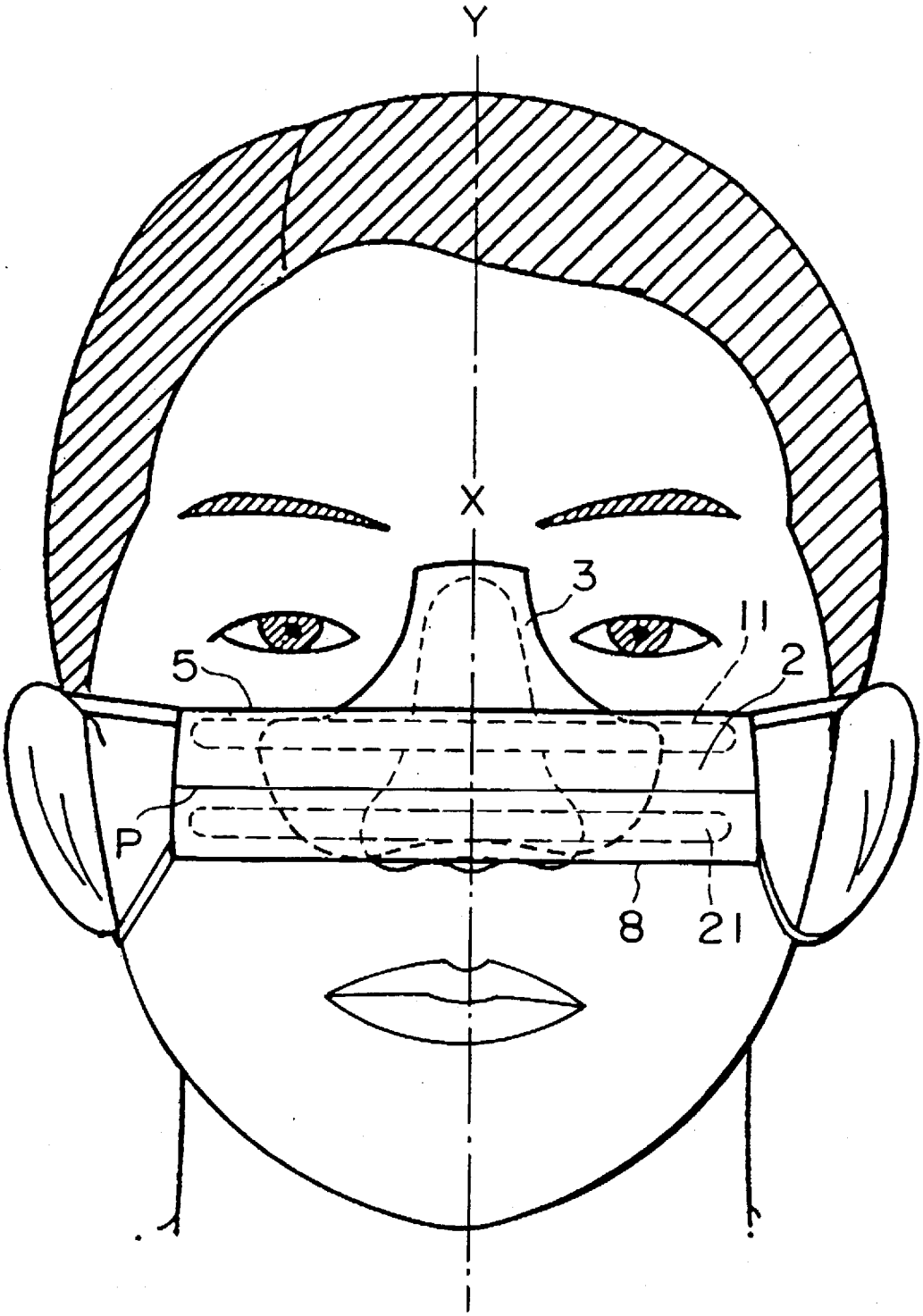

FIG. 17A is a diagram showing another modification example of the mask maintaining warmth in the nasal area of the present invention as worn over the face with the ribs folded.

Figure 17B:
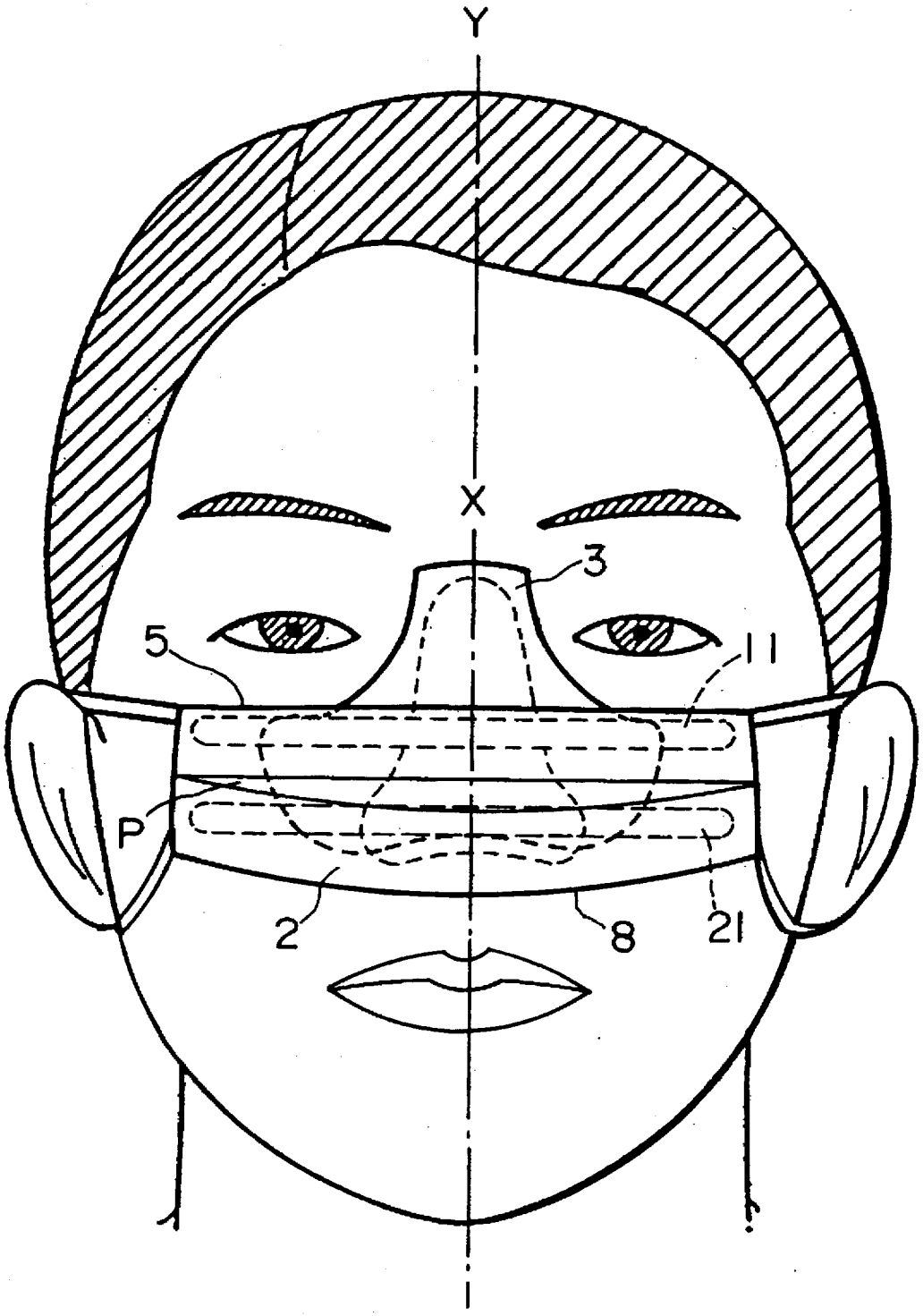

FIG. 17B is a diagram showing another modification example of the mask maintaining warmth in the nasal area of the present invention as worn over the face with the ribs spread.

Figure 18A:
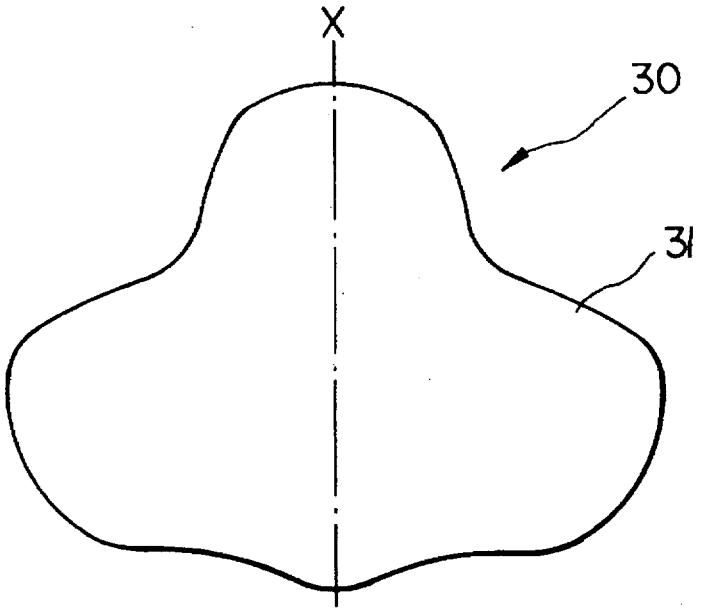

FIG. 18A is a frontal view showing the nasal area warmth maintenance device of the present invention.

Figure 18B:
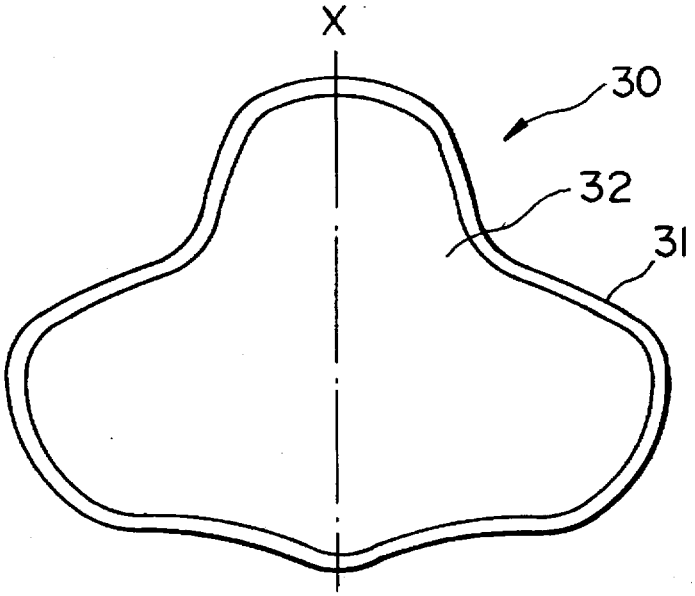

FIG. 18B is a back view showing the nasal area warmth maintenance device of the present invention.

Figure 19:
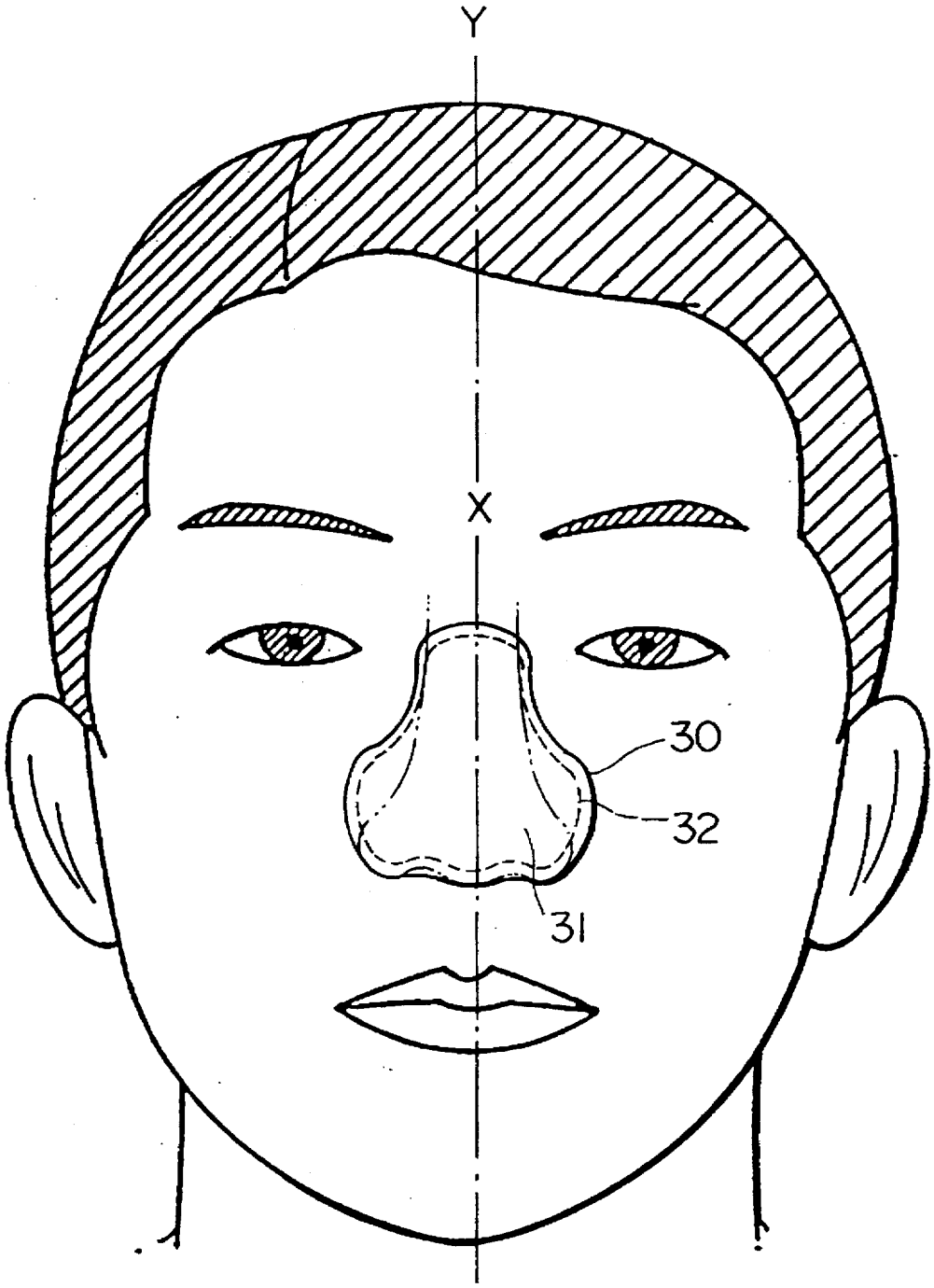

FIG. 19 is a diagram showing the nasal area warmth maintenance device shown in FIG. 18 as worn over the face.

DETAILED DESCRIPTION OF THE PREFERRED EMBODIMENTS

The mask maintaining warmth in the nasal area of the present invention basically comprises a main body, a nasal area warmth-maintenance portion, and a strap. When this mask maintaining warmth in the nasal area is attached to the face by pulling the strap over the ears, the nasal area warmth-maintenance portion provided in the central portion of the sheet-form main body covers at least the nasal area, and the upper end portion thereof protrudes from one side of the main body so as to cover at least the top portion of the nose.

With the mask maintaining warmth in the nasal area of the present invention, the nasal area warmth-maintenance portion may be formed as a part of the main body, or formed separately from the main body and attached to the main body at at least one point. However, if the nasal area warmth-maintenance portion is formed separately from the main body, then it is desirable that the lower end portion thereof be attached to the main body. Additionally, the nasal area warmth-maintenance portion may be attached to the main body so as to be able to be freely removed or reattached.

In either case, it is desirable that the upper end portion of the nasal area warmth-maintenance portion be formed in a three-dimensional manner so as to conform to the shape of the top portion of the nose. In order to achieve this, it is desirable that a metallic wire be provided along at least the upper end portion of the above-mentioned nasal area warmth-maintenance portion, wherein the metallic wire may be in the shape of a flat sheet. Additionally, the metallic wire may be formed as a loop beneath the surface of the mask maintaining warmth in the nasal area. The material for this metallic wire should preferably be a material having ductility which is able to be shaped by bending, or an alloy having mnematic properties, i.e., an alloy having the ability to revert to a pre-specified shape under certain environmental conditions, may also be used.

Hereinbelow, the present invention will be explained in detail with reference to the drawings.

Figure 1A:
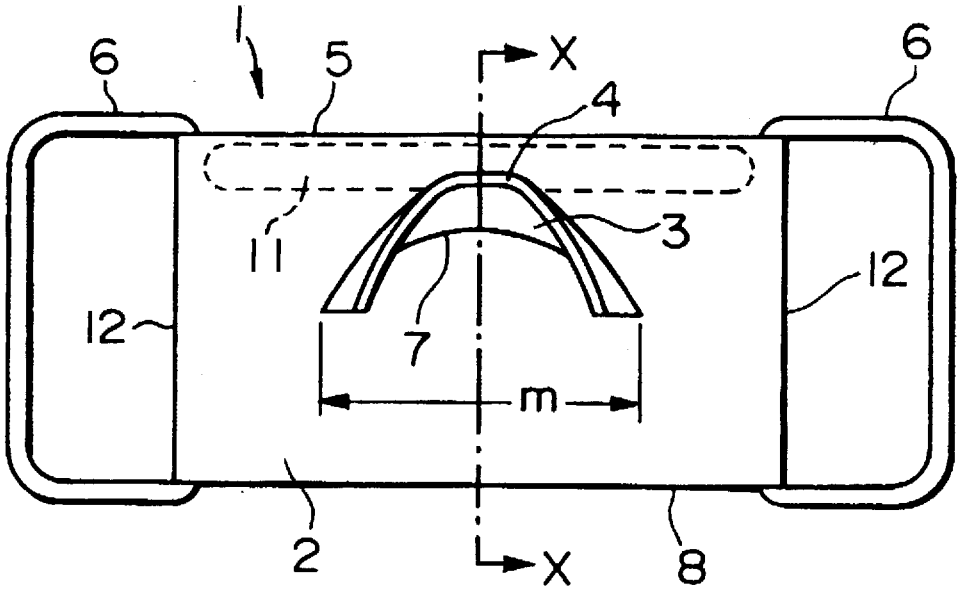
FIG. 1A is a front view of the first embodiment of a mask maintaining warmth in the nasal area of the present invention as seen from inside.
Figure 1B:
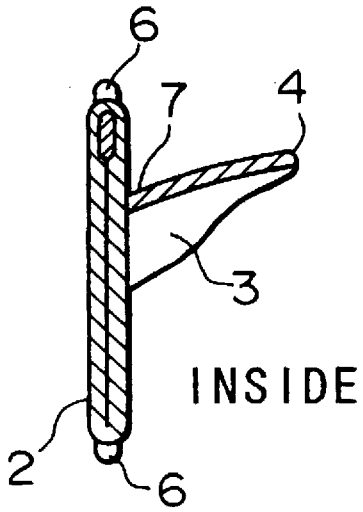
FIG. 1B is a sectional view along the line X—X of FIG. 1A.

FIGS. 1A and 1B show the first embodiment of the mask maintaining warmth in the nasal area of the present invention, wherein the mask for maintaining warmth in the nasal area 1 comprises a main body 2 formed from layered gauze in a rectangular shape, a nasal area warmth-maintenance portion 3 formed, separately from the main body 2 from skin-colored felt in the form of an inverted T, and straps 6 and 6 formed from rubber strands.

As seen in FIG. 1A, when the mask maintaining warmth in the nasal area 1 is seen from the inside (the side contacting the face) of the main body 2, the lower end portion 7 of the nasal area warmth-maintenance portion 3 is stitched to the central portion of the main body 2, so as to form a protruding curve in the direction of the upper portion 5 of the main body 2.

It is preferable that a metallic wire 11 be embedded at least along the upper portion 5 of the mask main body 2. This metallic wire 11 should preferably be flexible, so that by pressing down on the mask maintaining warmth in the nasal area 1 while it is being worn, the shape of the main body 2 can be formed into a three-dimensional shape conforming to a shape of the face.

Additionally, straps 6 and 6 are attached to both ends of each side portion 12 and 12 of the main body 2, and by laying these straps 6 and 6 over the ears, the mask maintaining warmth in the nasal area 1 is able to be affixed to the face.

Figure 2A:
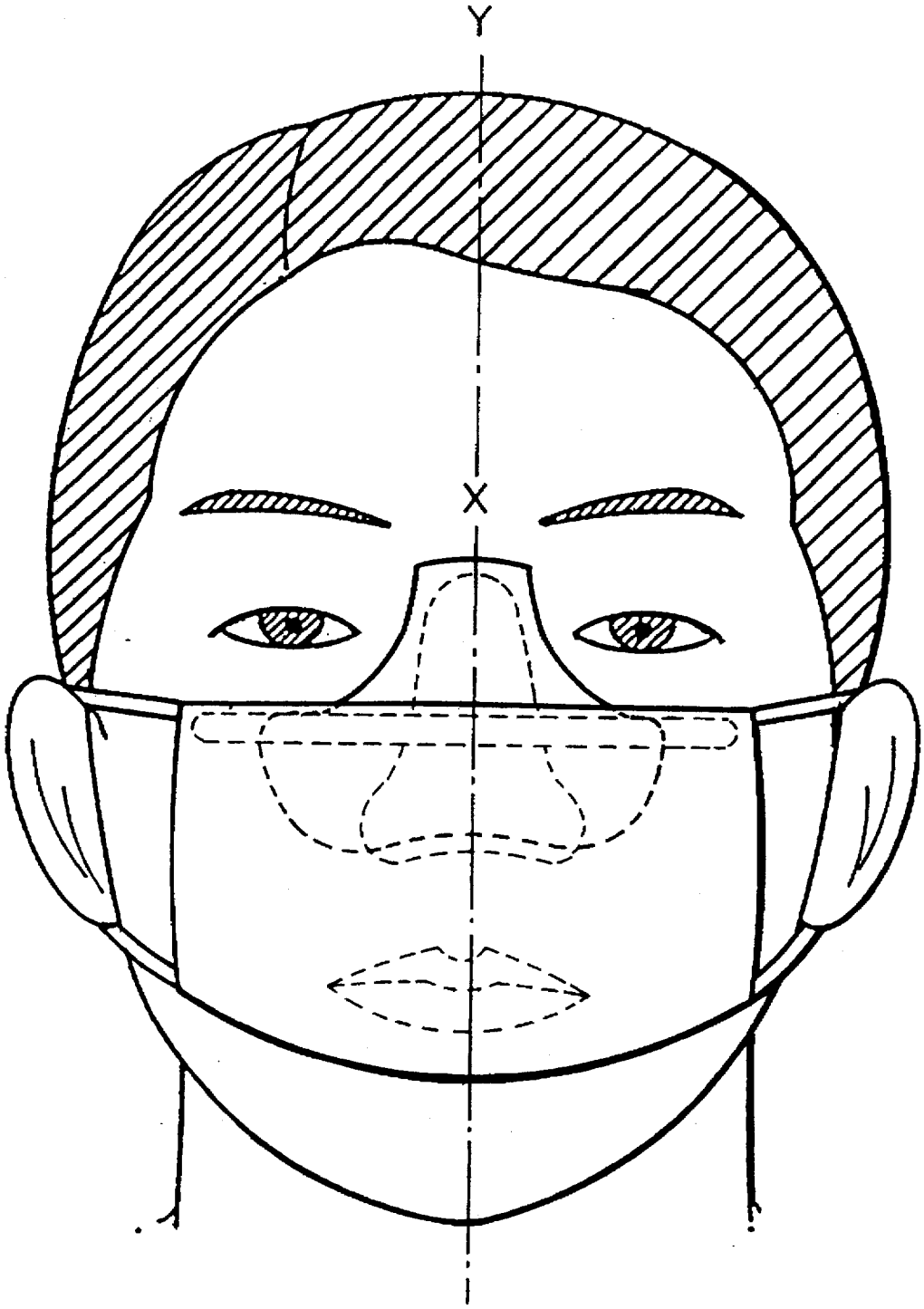
FIG. 2A is a front view of an example of the first embodiment of a mask maintaining warmth in the nasal area of the present invention when worn over the face.

FIG. 2A shows the state of the present embodiment of the mask maintaining warmth in the nasal area 1 when worn over the face. In FIG. 2A, the mask maintaining warmth in the nasal area 1 is fixed to the face by the straps 6 and 6 which are laid over the ears. In this state of wearing, the main body 2 which is in the form of a rectangular sheet covers the mouth and a portion of the nasal area, and the nasal area warmth-maintenance portion 3 which is attached to the central portion of the main body 2 covers at least the entirety of the nasal area. Additionally, this nasal area warmth-maintenance portion 3 has approximately an inverted T-shape, and the upper end portion thereof projects from the upper portion 5 of the main body 2, covering at least the upper portion of the nasal area n.

For the purposes of the present specification, the nasal area n is defined as the entire body of the nose which protrudes on either side of a center line Y on the face, and the upper portion of the nasal area n is defined as the part of the nasal area n which is not covered by the main body 2.

The present invention was achieved through the realization that the occurrence of symptoms of allergic nasal inflammation, such as hay fever, could be prevented and symptoms which already exist could be relieved or eliminated by maintaining or adding warmth to at least both nasal cavities or the nasal cavities and the sinuses. That is, the present inventor discovered, as explained later in the test data, that when measuring the temperature distribution on the face, the temperature around the nasal crest in subjects suffering from an allergic nasal inflammation was low in comparison to that of healthy test subjects, and the allergic symptoms could be prevented, relieved, or eliminated by holding the temperature around the nasal crest at the same temperature or above that of healthy subjects.

Figure 3:
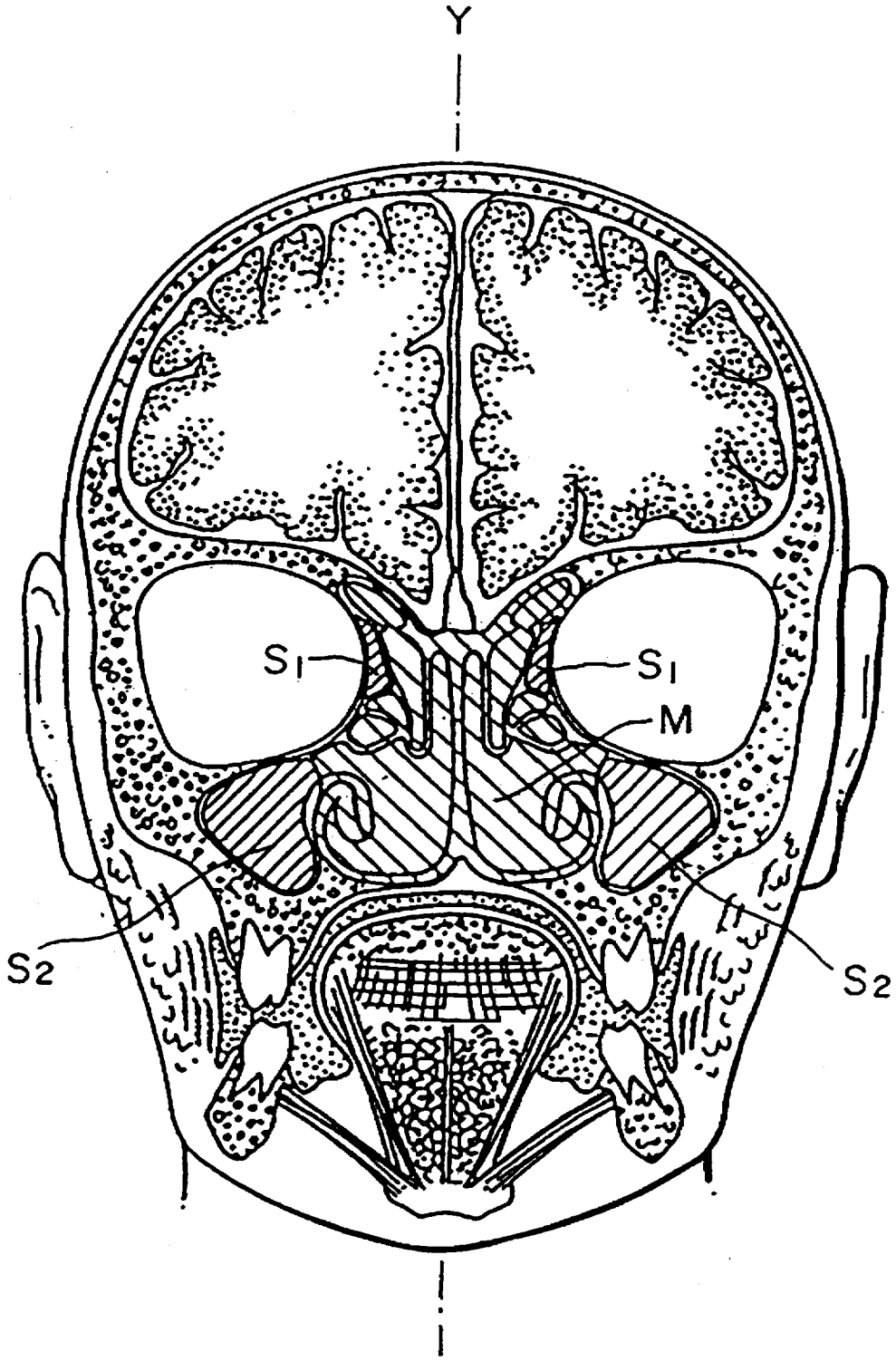
FIG. 3 is a transparent front view of the human face.

The positions of the nasal cavities and sinuses of the face are schematically shown in FIG. 3. Here, the cavities on either side of the center line Y are the nasal cavities M. On both sides of the nasal cavities M, and connected thereto, are the ethmoidal cavity $s_1$ in the vicinity of the optic cavity and the maxillary cavity $s_2$ under the cheek bones, which are the sinuses. Here, the sinuses s refer to either one or both of the ethmoidal cavity $s_1$ as well as the maxillary cavity $s_2$.

In the state of wearing shown in FIG. 2A, the nasal area warmth-maintenance portion 3 in the shape of an inverted T is formed so as to conform to the shape of the nasal area m and the surrounding areas, so that both the nasal cavity M and the sinuses s are effectively warmed.

Although the reason for the correlation between the temperature of the nasal crest area and the occurrence of the symptoms of hay fever and allergic nasal inflammation are not yet clear, it is believed that when the temperature of the nasal area is low, physical changes which are harmful to the normal biological mechanisms of the nasal membranes occur such as restrictions to the blood flow, insufficiency of oxygen or nourishment to the cells, or inactivity of the metabolism due to the reduced function of the cells, resulting in the nasal membrane becoming extremely sensitive to stimulation such as the attachment of allergens. Therefore, if at least the nasal cavity, or both the nasal cavity and the sinuses, are kept warm by maintaining the temperature of the nasal area, the disordered immune system functions of the nasal membrane return to their normal starer making it possible to prevent, relieve, or eliminate symptoms. Furthermore, if warmth is added instead of simply maintaining the temperature, more certain prevention or faster relief or elimination can be expected.

In order to ensure that the main body conforms to the surface of the face along the horizontal direction when the mask maintaining warmth in the nasal area 1 is worn in such a way that the side to which the nasal area warmth-maintenance portion 3 is attached contacts the face, the lengths of the straps 6 may be adjusted. Alternatively, an elastic force can be used to affix the mask maintaining warmth in the nasal area 1 to the face, by forming the straps 6 from an elastic material such as rubber. Since the upper end portion 4 of the nasal area warmth-maintenance portion 3, of which the lower end portion 7 is affixed to the central portion of the main body 2, is pushed upwards over the top portion of the nasal area n when the mask maintaining warmth in the nasal area 1 is worn over the face, the upper end portion 4 solidly cradles and covers the upper portion of the nasal area n, so that when seen from the front in FIG. 2, it projects from the upper portion 5 of the main body. The length of the projection of the upper end portion 4 should preferably be within a range of 5 mm to 30 mm from the upper portion 5 when the mask is worn over the face.

Furthermore, it is possible to reduce the space between the surface of the face and the mask maintaining warmth in the nasal area by pressing on the upper portion 5 of the main body, in which is embedded a flexible metallic wire 11, so as to form the metallic wire 11 into a shape conforming to the shape of the horizontal direction of the nasal area n. In this case, because the nasal area warmth-maintenance portion 3 is positioned so as cover the nasal area n and surrounding area.

Figure 2B:
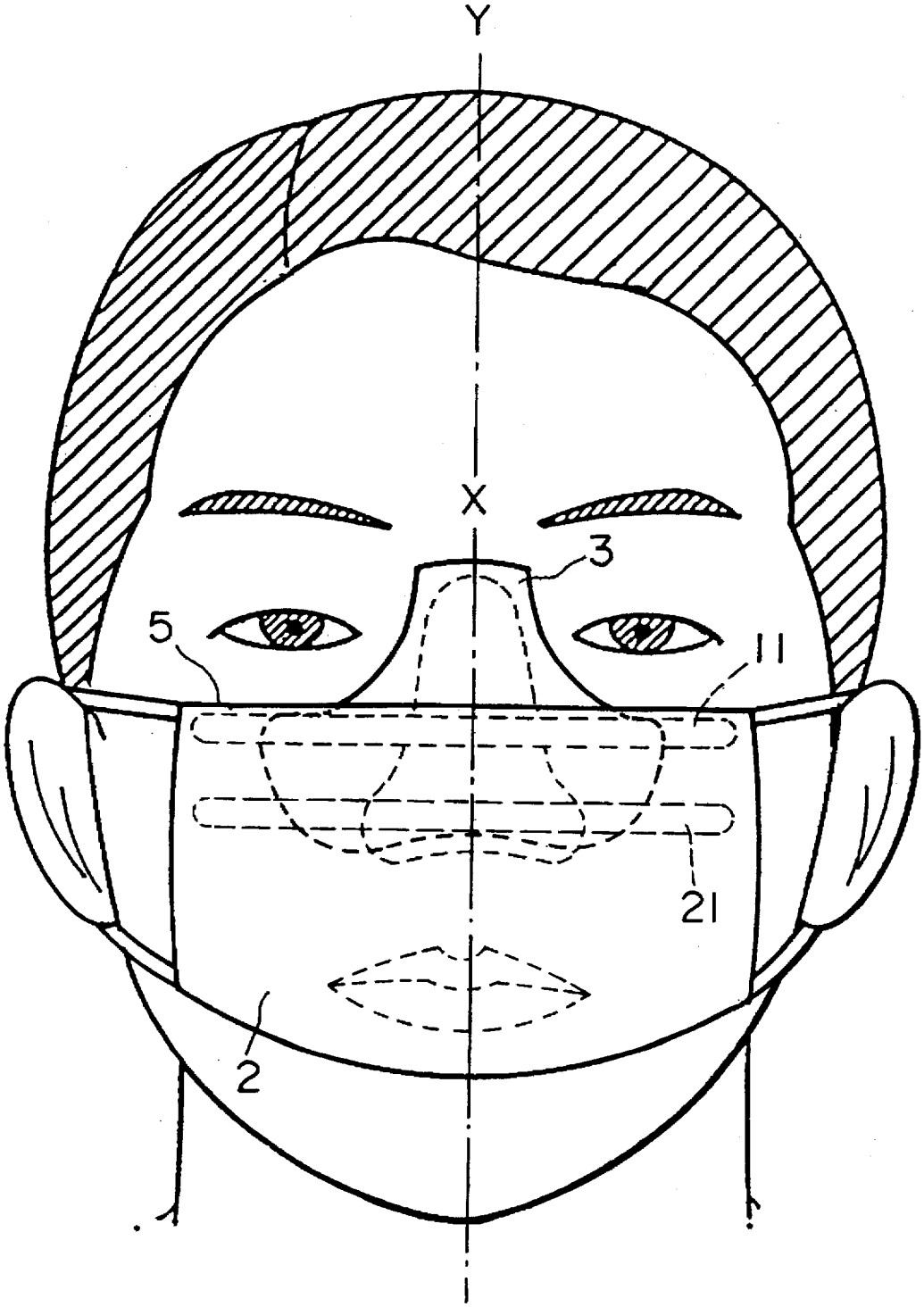
FIG. 2B is a front view of another example of the first embodiment of a mask maintaining warmth in the nasal area of the present invention when worn over the face.

Additionally, it is desirable not only that a flexible metallic wire 11 be embedded in the upper portion 5 of the main body 2, but also that a second metallic wire 21 be embedded parallel to the first metallic wire 11. It is further desirable that the second metallic wire 21 be embedded at the position at which the lower end portion 7 of the nasal area warmth maintenance portion is attached to the main body 2. When a mask maintaining warmth in the nasal area having this second metallic wire 21 is worn over the face, the second metallic wire 21 goes over the end of the nose as shown in FIG. 2B. Therefore, if the first and second flexible metallic wires 11 and 21 are shaped to conform to the form of the nose at the respective positions by pressing on the mask maintaining warmth in the nasal area 1, then the attachment between the nasal area warmth maintenance portion 3 and the nasal area further improves, and the warmth maintenance effect is further increased.

The inverted T-shape of the nasal area warmth-maintenance portion 3 of the present embodiment as shown in FIG. 1 is effective for maintaining warmth in the nasal area n and surroundings, especially the sinuses below each cheek; however it is not necessarily restricted to such a shape, and for example, may be circular, elliptical, oval, triangular with rounded angles, trapezoidal, polygonal (such as diamond shaped) , or heart-shaped.

In addition to felt as mentioned above, the material used for the nasal area warmth-maintenance portion 3 can be any type of material which is able to maintain warmth in the nasal area n and its surroundings. For example, it can be formed from one, or a layering of, at least two of materials chosen from the group consisting of woven cloth, cloth, unwoven cloth, felt, paper, cotton plastic, foam plastic, rubber, foam rubber, sponge, natural leather, synthetic leather, artificial skin, and metallic foil. More specifically, woven cloth, knitted cloth, unwoven cloth, gauze, thin paper such as tissue paper, or the layering thereof; the layering of a layer of material having high air-holding capability such as gauze or degreased cotton; or a layered body including at least one of the group consisting of plastic, foam plastic, rubber, foam rubber, sponge, metallic foil, natural leather, synthetic leather, or artificial skin made from collagen or polyglutamates may be suggested.

Additionally, it is desirable that at least the outer surface of the upper end portion 4 of the nasal area warmth-maintenance portion 3 be colored to skin color. When this type of mask maintaining warmth in the nasal area is worn, it is only possible to slightly see a skin-colored upper end portion 4 over a normal gauze mask, so that there is no reason for concern with one's appearance. Alternatively, at least the upper end portion 4 of the nasal area warmth-maintenance portion 3 can be made transparent. In this case, there is no large difference in appearance from that in which a normal mask is worn because the skin is able to been seen through the transparent upper end portion 4, so that it can be worn without self-consciousness. As examples of such transparent materials, polyethylene, polypropylene, vinyl polychloride, polybutane, polyethylene/vinyl acetate copolymers, polyvinyl alcohol, poly(meth)acrylic resin, polyesters, polycarbonate, ABS resin, polystyrene, silicone resin, natural or synthetic resin, gelatin, cellulose-type resins, or gel-form polymers, may be mentioned. When these transparent materials are used, the appearance during wearing can be further improved by making at least the outer surface non-glossy, or embossing them with designs mimicking the shape of the skin.

Additionally, it is possible to perform a raising procedure, floc processing, or embossing on at least the site of the nasal area warmth-maintenance portion 3 contacting the face. With the application of this type of processing, a heat-insulating air pocket is formed between the facial surface and the nasal area warmth-maintenance portion 3, thereby further increasing the warmth-maintenance ability of the nasal area warmth-maintenance portion 3.

The heat conductivity of the nasal area warmth-maintenance portion 3 is not especially restricted, but should preferably be less than $1\times10^{-3}$ cal/cm·sec·°C. Beyond this range, the radiation of heat becomes too large, making it difficult in practice to maintain warmth in the nasal area unless a heating unit is used.

The main body 2 of the mask maintaining warmth in the nasal area 1 of the present embodiment is a permeable sheet covering at least both the nostrils and the mouth when worn. Main body 2 not only absorbs or blocks the passage of allergens in the form of air-borne microscopic particles, but also prevents cold air from being directly inhaled into the nasal cavity where it could irritate the mucus membranes of the nasal cavity n and sinuses s from within. The shape of this main body 2 is normally rectangular, but may be elliptical or polygonal (such as triangular). The material of the main body 2 may be any material conventionally used in the field as long as it is in the form of a sheet and is permeable. Although layered gauze or a combination of gauze and degreased cotton are normally used, layers of thin paper such as tissue paper, unwoven cloth, or permeable foam plastic or foam rubber sheets may also be used.

While it is preferable that a metallic wire 11 for fitting the main body 2 to the shape of the face during wearing is embedded in at least the upper portion 5 of the main body 2, this metallic wire 11 does not necessarily have to be provided in only the upper portion 5, and it may be bent downwards at either end of the upper portion 5, extending along both side portions 12 and 12 to the lower end portions of the side portions 12 and 12. Furthermore, it can be provided on the bottom end 8, thereby forming a ring around the entire outer circumference of the main body 2. It is preferable that this metallic wire 11 be flat, in order to prevent wrinkling of the mask of the main body 2, and to allow attachment along a wide area of the face.

When the nasal area warmth-maintenance portion 3 and the main body 2 are formed as separate bodies, as in the present embodiment, it is preferable that the nasal area warmth-maintenance portion 3 and the main body 2 be connected at at least the lower end portion 7 of the nasal area warmth-maintenance portion 3. Since the upper end portion of the nasal area warmth-maintenance portion 3 is stably supported by the nasal crest and the upper portion of the main body 5, if slipping is prevented by connecting to the main body at the lower end portion 7, then the entire nasal area warmth-maintenance portion 3 can be held at a designated position.

With the mask maintaining warmth in the nasal area 1 of the present invention, the nasal area warmth-maintenance portion 3 can be pre-formed into a three-dimensional shape so that at least an upper end portion 4 thereof covers at least the upper portion of the nasal area n.

Since this three-dimensionally-formed nasal area warmth-maintenance portion 3 is pressed by the main body 2, suitably attaching to the facial surface, and the upper end portion 4 of the nasal area warmth-maintenance portion 3 solidly covers the upper end of the upper portion of the nasal area n, the entire nasal area n and the surroundings are effectively warmed. Furthermore, since the eyes are not blocked by the main body 2, the field of view is not obstructed when the mask maintaining warmth in the nasal area 1 is worn.

Additionally, since the main body 2 and the nasal area warmth-maintenance portion 3 of the mask maintaining warmth in the nasal area 1 are both formed from pliant sheets, it can be flattened or folded as needed for storage or carrying.

The nasal area warmth-maintenance portion 3 and the main body 2 can be connected irreversibly as mentioned above by sewing, gluing, or pinning, but they may also be detachably connected using snaps, velcro, hooks, zippers, laces, or the like. When they are detachably connected, it is possible to wash only the main body 2 by removing the nasal area warmth-maintenance portion 3. Additionally, it is possible to make either the nasal area warmth-maintenance portion 3 or the main body 2 disposable. In particular, the protrusion length of the upper end portion 4 of the nasal area warmth-maintenance portion velcro is used as a connector, so it can be fit to all types of facial features and dimensions from those of children through those of adult males and females.

Figure 4:
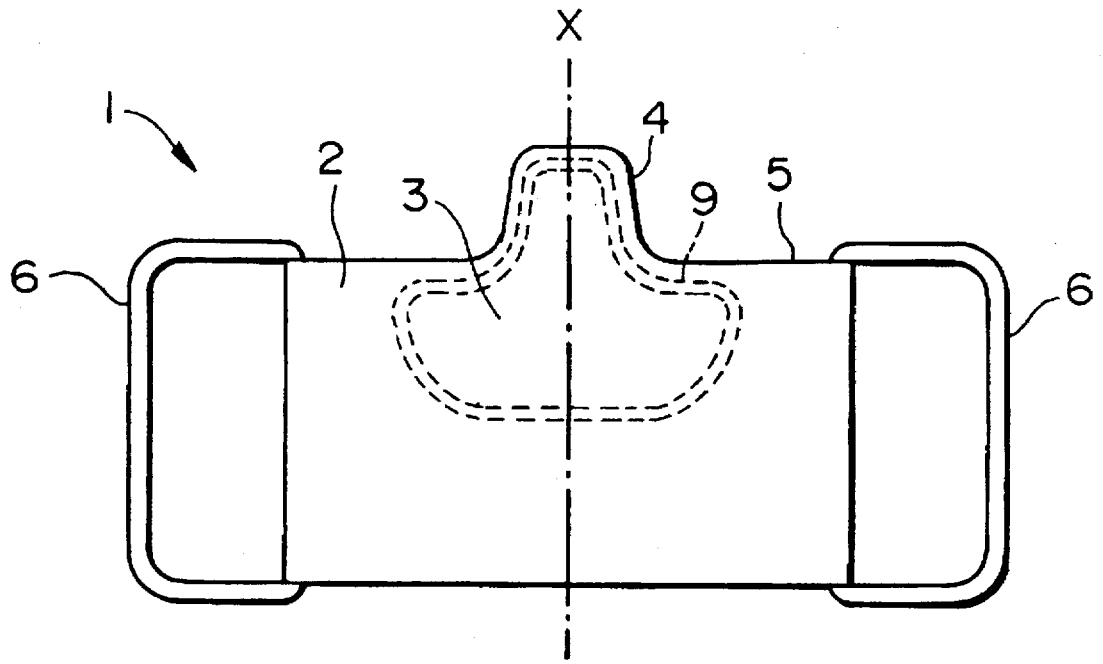
FIG. 4 is a front view showing an example of the second embodiment of the mask maintaining warmth in the nasal area of the present invention.

FIG. 4 shows the second embodiment of the mask maintaining warmth in the nasal area of the present invention. In this embodiment, the main body 2 and the nasal area warmth-maintenance portion 3 are formed unitarily. That is, as shown in FIG. 4, the main body 2 formed from layered gauze has an upper end portion 4 protruding from the central portion of the upper portion 5 along the vertical line x. The nasal area warmth-maintenance portion 3 of this embodiment is formed from the central portion of the main body 2 to the upper end portion 4 in an area corresponding to the nasal area n. In this embodiment, a flexible metallic wire 9 is embedded through the entire outer perimeter of the nasal area warmth-maintenance portion 3 so that the nasal area warmth-maintenance portion 3 can be fitted to the shape of the nasal area n.

If the upper end portion 4 is positioned upwards and the straps 6 are laid over the ears in a manner similar to a normal mask when the mask maintaining warmth in the nasal area 1 of the present embodiment is worn, then the nasal area warmth-maintenance portion 3 is positioned so as to cover the entire nasal area n. By pressing on the metallic wire 9 from the outside, or grasping the metallic wire 9, it can be shaped so that the upper end portion 4 solidly covers the upper portion of the nasal area n and the entire nasal area warmth-maintenance portion 3 solidly covers and is affixed to the facial features of the nasal area n and its surroundings.

When the mask maintaining warmth in the nasal area 1 is shaped in this way, the entire nasal area n and its surroundings can be effectively warmed because the area which is the nasal area warmth-maintenance portion 3 appropriately attaches to the facial surface at the nasal area and its surroundings, and the upper end portion 4 extends to the upper portion of the nasal area n and solidly covers it. Since the main body 2 does not block the eyes, this mask maintaining warmth in the nasal area 1 will not obstruct the field of view when worn.

Figure 5:
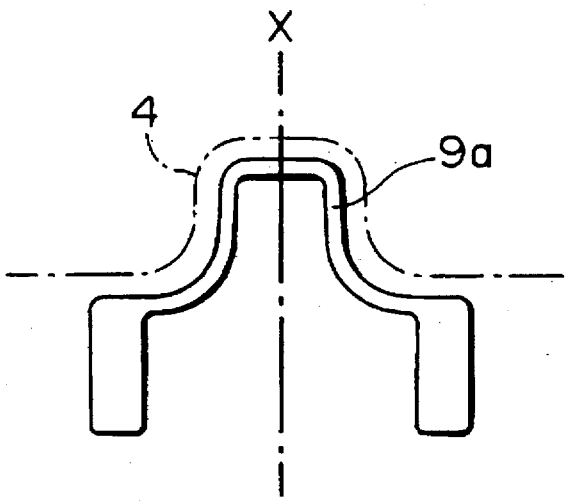
FIG. 5 is a plan view showing the shape of the metallic wiring used in another example of the second embodiment of the mask maintaining warmth in the nasal area of the present invention.

Although the metallic wire 9 used in the mask maintaining warmth in the nasal area 1 shown in FIG. 4 is provided as a loop around the entire perimeter of the nasal area warmth-maintenance portion 3, the metallic wire 9 does not necessarily have to be in the form of a loop, but should be provided along at least the upper end portion 4. For example, as indicated by reference numeral 9*a* in FIG. 5, it can be formed in a U-shape or a V-shape by punching it out from a metallic sheet. Additionally, this metallic wiring may be covered by a plastic such as polyethylene or polyvinylchloride, or held by a ribbon formed from these types of plastics.

Figure 6:
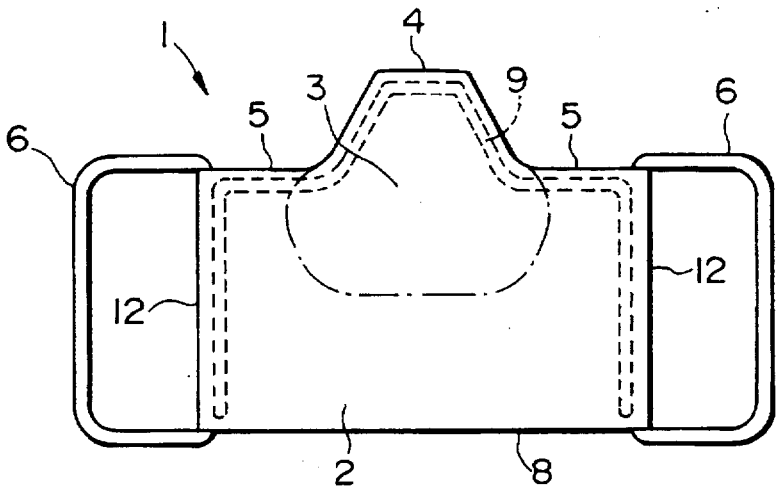
FIG. 6 is a front view showing yet another example of the second embodiment of the mask maintaining warmth in the nasal area of the present invention.

This metallic wire 9 is not restricted to only the nasal area warmth-maintenance portion 3, and may be provided from the upper end portion 4 to both ends of the upper portion 5 of the main body 2. Furthermore, as shown in FIG. 6, it can be provided so as to meet the bottom ends of both side portions 12 and 12. In this case, if the mask maintaining warmth in the nasal area 1 is worn over the face by pressing the portions provided with the metallic wire 9 onto the face, and depending on the situation, either grasping and shaping the metallic wire so that the upper end portion 4 solidly covers the upper portion of the nasal area, or shaping the upper portions 5 and 5 to conform to the shape of the face, not only does the nasal area warmth-maintenance portion 3 effectively warm the nasal area and its surroundings, but the main body 2 covers a wide area of the face, thereby improving the warmth and dust-prevention effect. Additionally, the main body 2 tends not to become wrinkled, thereby improving the appearance when worn. While it is preferable that this metallic wire 9 be formed from a flexible metal, a mnematic alloy may also be used. A mnematic alloy is an alloy having the property of returning to its original form when heated, such as, for example, a nickel-titanium alloy having high elasticity. Therefore, if the mask maintaining warmth in the nasal area 1 of the present invention is made by using a metallic wire of a mnematic alloy with an original shape conforming to the shape of the nasal area n and its surroundings, even if the shape of the mask maintaining warmth in the nasal area is changed for storage or transport, the nasal area warmth-maintenance portion 3 is shaped to a three-dimensional form corresponding to the nasal area n when worn because the metallic wire 9 will return to its original form due to the heat of the body or breath.

Additionally, while a metallic wire 9 is provided in at least the upper end portion of the nasal area warmth-maintenance portion in order to maintain a three-dimensional shape of the mask maintaining warmth in the nasal area of the present embodiment, the means for maintaining the three-dimensional shape is not necessarily restricted to this. For example, the entire nasal area warmth-maintenance portion 3 can be formed from a flexible metallic foil such as aluminum foil, or metallic foil can be layered into the entire nasal area warmth-maintenance portion 3 or a portion thereof.

Particularly in the case of the present embodiment in which the nasal area warmth-maintenance portion 3 and the main body 2 are formed unitarily, it can be made easier for at least the upper end portion 4 of the nasal area warmth-maintenance portion 3 to be formed in to a three-dimensional shape by employing at least one vertical rib parallel to the center line X of the mask maintaining warmth in the nasal area 1 or forming at least one horizontal rib perpendicular to the center line X.

Figure 7A:
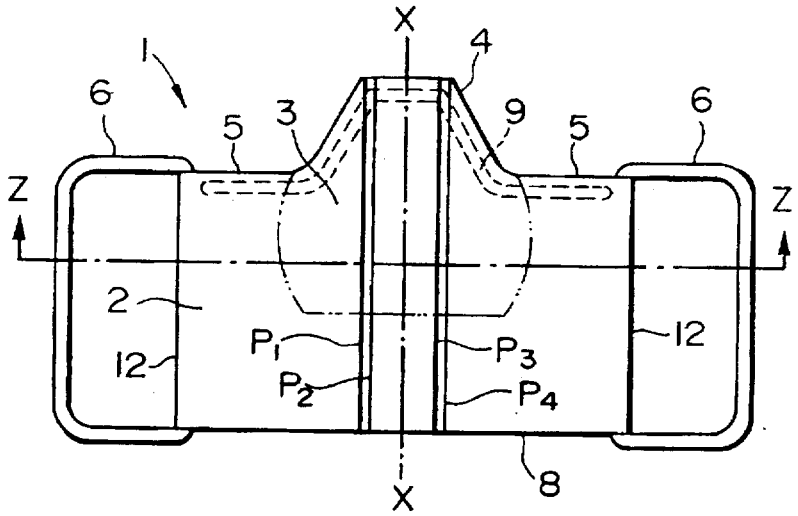
FIG. 7A is a front view showing yet another example of the second embodiment of the mask maintaining warmth in the nasal area of the present invention.

An example of a mask maintaining warmth in the nasal area having vertical ribs is shown in FIG. 7. The nasal area warmth-maintenance portion 3 and the main body 2 of mask maintaining warmth in the nasal area 1 are formed unitarily from a sheet of layered tissue paper. Four vertical ribs p1, p2, p3, and p4 are formed parallel to and symmetric with regard to the center line X, and for each rib, an upper end is fixedly connected to the upper end portion 4 and the lower end is fixedly connected to the lower portion 8 of the main body. In this mask maintaining warmth in the nasal area 1, a metallic wire 9 held by a plastic ribbon is embedded so as to extend along the upper end portion 4 and reach both ends of the upper portion 5 and 5 of the main body.

When the mask maintaining warmth in the nasal area 1 of FIG. 7 is worn, the main body 2 is pulled from both sides by the straps 6, so that the protruding nasal area causes the nasal area warmth-maintenance portion 3 to bulge outwardly. Then, in response to this change, the upper end portion 4 deforms in order to solidly cover the upper area of the nose. Furthermore, if the metallic wire 9 is pressed onto the surface of the face, and depending on the situation, the upper end portion 4 is shaped so as to solidly cover the upper portion of the nose by grasping the metallic wire 9, or the upper portion 5 is shaped so as to conform to the shape of the facial surface, then not only does the nasal area warmth-maintenance portion 3 effectively warm the nasal area n and its surroundings, but because the main body 2 covers a wide area of the face, the warmth maintenance and dust exclusion effects are improved, as is the outward appearance. Since this mask maintaining warmth in the nasal area is made of tissue paper, it may be used as an inexpensive disposable mask maintaining warmth in the nasal area 1.

Figure 8A:
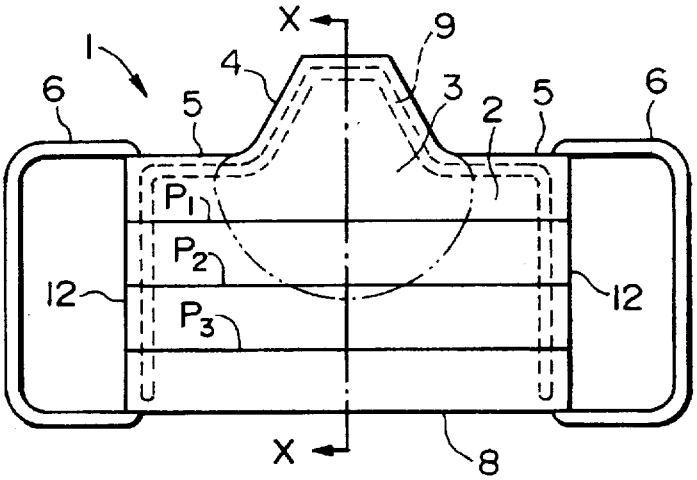
FIG. 8A is a front view showing yet another example of the second embodiment of the mask maintaining warmth in the nasal area of the present invention.

FIG. 8 shows an embodiment of the mask maintaining warmth in the nasal area having horizontal ribs. With this mask maintaining warmth in the nasal area 1, the nasal area warmth-maintenance portion 3 and the main body 2 are formed as a single body, three horizontal ribs p1, p2, and p3 are formed on the main body 2, and each rib is affixed at both side portions 12 and 12 of the main body 2. Initially, with this mask maintaining warmth in the nasal area 1, a metallic wire 9 made of mnematic alloy extends from the perimeter of the upper end portion 4 and along the upper portions 5 and 5 of each side of the main body so as to reach the lower end portions of each side portion 12 and 12.

When the mask maintaining warmth in the nasal area 1 of FIG. 8 is worn, both sides of the main body 2 are pulled by the straps 6 and 6 so that the protrusion of the nasal area causes the nasal area warmth-maintenance portion 3 to bulge outwardly. As a result of this change, the main body 2 curves outwardly along the vertical line X, and it is possible to vertically adjust the position of the mask to fit to the upper portion of the nose by stretching the upper end portion 4 in the X-direction by extending the ribs p1, p2, and p3. Furthermore, if the metallic wire 9 is heated by body heat, the original form of the mnematic alloy will return, shaping the upper end portion 4 so as to solidly cover the upper portion of the nose.

Figure 7B:
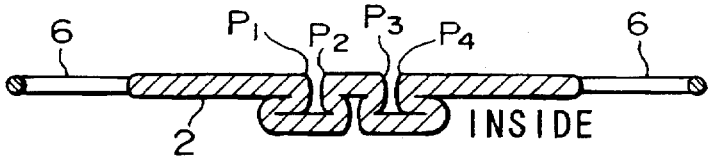
FIG. 7B is a sectional view along line Z—Z of FIG. 7A.
Figure 8B:
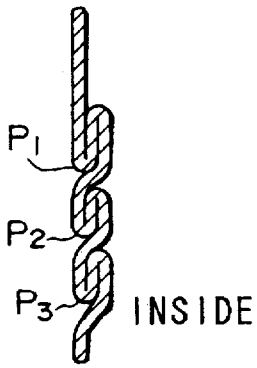
FIG. 8B is a sectional view along the line X—X of FIG. 8A.

In the case of either vertical or horizontal ribs, the orientation of the group of ribs may be interchanged, and they may have an opposing arrangement as shown in FIG. 7B or an orderly arrangement as shown in FIG. 8B.

Figure 9A:
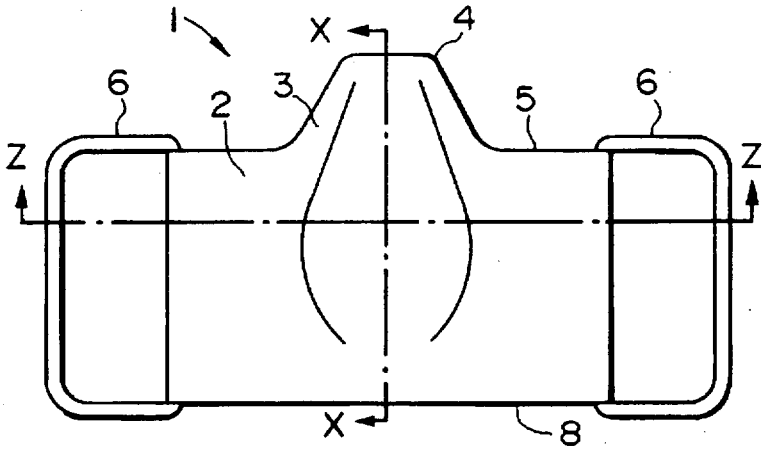
FIG. 9A is a front view showing yet another example of the second embodiment of the mask maintaining warmth in the nasal area of the present invention.
Figure 9B:
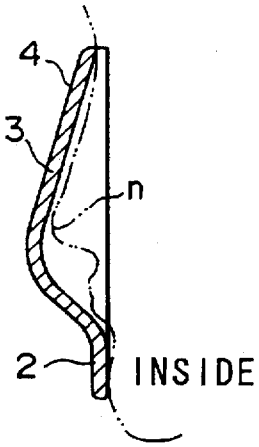
FIG. 9B is a sectional view along the line X—X of FIG. 9A.
Figure 9C:
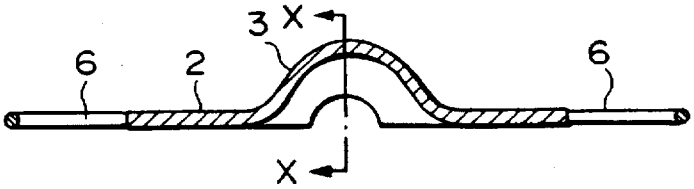
FIG. 9C is a sectional view along the line Z—Z of FIG. 9A.

In the present embodiment also, the nasal area warmth-maintenance portion 3 can be pre-formed into a three-dimensional shape so that at least the upper end portion 4 covers at least the upper portion of the nasal area. FIG. 9 shows an example in which the nasal area warmth-maintenance portion 3 and the main body 2 are formed unitarily, and the nasal area warmth-maintenance portion is pre-formed into a three-dimensional shape to cover the nasal area n. In FIG. 9, this mask maintaining warmth in the nasal area 1 is formed three-dimensionally, so that the central portion of the main body 2 formed from a sheet of layered tissue paper bulges outwardly to form a nasal area warmth-maintenance portion 3 conforming to the curves of the nasal area n, and the upper end portion 4 of the nasal area warmth-maintenance portion 3 is provided so as to protrude from the upper portion 5 of the main body. The present embodiment can be formed by spreading, for example, a polyvinyl alcohol-type glue onto the main body 2 while maintaining permeability, and performing thermocompression molding.

When the mask maintaining warmth in the nasal area 1 of FIG. 9 is worn, the nasal area warmth-maintenance portion 3 formed in the central portion of the main body 2 solidly covers the nasal area and its surroundings, so that there is no need to shape the nasal area warmth-maintenance portion 3 to conform to the shape of the nose after it has been put on. Additionally, since the entire mask maintaining warmth in the nasal area 1 is formed from tissue paper and a metallic wire is not used, it can be used as a mask maintaining warmth in the nasal area 1 which is inexpensive, disposable, and the entirety of which can be burned.

With the mask maintaining warmth in the nasal area 1 of the present invention, for each of the embodiments mentioned above, it is possible to combine all types of materials in the nasal area warmth-maintenance portion 3 in order to increase the warmth maintenance ability or to add heat.

For example, metallic foil may be incorporated into at least the nasal area warmth-maintenance portion 3. If metallic foil is incorporated into the entirety or a portion of the nasal area warmth-maintenance portion, the metallic foil reflects and traps heat radiating from the skin, allowing heat to accumulate in the space between the nasal area warmth-maintenance portion 3 and the nasal area n, thereby increasing the warmth-maintenance ability.

As examples of metallic foils, aluminum foil and aluminum alloy foil are appropriate for use. The nasal area warmth-maintenance portion 3 can be formed from only a metallic foil. Alternatively, on a surface of a nasal area warmth-maintenance portion formed from cloth or plastic, metallic foil can be attached, a metallic coating in which metallic flakes have been dispersed in an appropriate medium can be coated, or a thin layer of metal may be formed by vapor deposition, galvanization, or lamination.

Metallic foil is not necessarily restricted to use in the nasal area warmth-maintenance portion 3, and may be used in the entirety or a portion of the main body 2.

A far-infrared radiative material can be used in at least the nasal area warmth-maintenance portion 3 of the mask maintaining warmth in the nasal area 1 of the present invention. As a far-infrared radiative material in this case, it is possible to use any material having the ability to receive heat radiating from the human body and convert it into far-infrared radiation. For example, one or a combination of two or more of far-infrared radiative ceramics, such as the metal oxides $Al_2O_3$, $SiO_2$, $TiO_2$, $Cr_2O_3$, $ZrO_2$, MgO, and $Fe_2O_3$, carbon compounds such as SiC, TiC, ZrC, and $B_4C$, or nitrides such as $Si_3N_4$, BN, and AlN.

If one or a mixture of two or more of these far-infrared radiative materials is used in the nasal area warmth-maintenance portion 3, an entirety or a portion of the main body 2 would be able not only to maintain but to add warmth to the nasal cavity and the sinuses.

These far-infrared radiative materials can be powdered and dispersed or suspended in an appropriate medium or vehicle, then used to impregnate or coat the nasal area warmth-maintenance portion 3 and the main body 2, if necessary. Additionally, it is possible to form the nasal area warmth-maintenance portion 3 of two or more layers, and insert the far-infrared radiative materials between the layers. At this time, in order to keep the powdered far-infrared radiative materials from flowing or moving between the layers, quilting can be applied to the entire nasal area warmth-maintenance portion 3, the far-infrared materials can be affixed by an adhesive, or the far-infrared radiative materials can be pre-shaped into a sheet-form using flexible binders. Additionally, if the nasal area warmth-maintenance portion 3 has a plastic or rubber layer, the powdered far-infrared radiative materials may be premixed into these layers.

Exothermic materials having metallic powder as the main components may be used in at least the nasal area warmth-maintenance portion 3. These exothermic materials, which make use of the heat released when a metallic powder reacts with the oxygen and water vapor in the air, are widely known and may be composed of, for example, a mixture of metallic powder and sodium chloride, as well as an oxidizing catalyst, if necessary. In order to prevent an exothermic reaction from occurring during storage, it is preferable that this mask maintaining warmth in the nasal area 1 be sealed in a bag which is impermeable to oxygen and water vapor.

If an appropriate amount of this exothermic material having metallic powder as its main component is used in at least the nasal area warmth-maintenance portion 3, the mask maintaining warmth in the nasal area 1, when worn, not only maintains warmth, but also adds heat to the nasal cavity and the sinuses over a long period of time due to a gradual exothermic reaction.

This exothermic material can be combined into the nasal area warmth-maintenance portion 3 using methods similar to the above-mentioned case for far-infrared radiative materials. In this case, because oxygen and moisture are required for the exothermic reaction, it is preferable to use a permeable multilayered material for the nasal area warmth-maintenance portion 3 and to insert the exothermic material between the layers.

Additionally, an exothermic material having calcium oxide as its main component can be used in at least the nasal area warmth-maintenance portion 3. This exothermic material, which makes use of the heat released when calcium oxide reacts with airborne moisture, is widely known, and it is possible to adjust the amount of heat released by controlling the amount of moisture contacting the calcium oxide. In order to prevent an exothermic reaction from occurring during storage, it is preferable that this mask maintaining warmth in the nasal area 1 be sealed in a moisture-proof bag.

If an appropriate amount of this exothermic material having calcium oxide as its main component is incorporated into at least the nasal area warmth-maintenance portion 3, the mask maintaining warmth in the nasal area 1, when worn, can not only maintain warmth, but can also add warmth to the nasal cavity and the sinuses over a long period of time due to a gradual exothermic reaction.

This exothermic material can be incorporated into the nasal area warmth-maintenance portion 3 using methods similar to the above-mentioned case for exothermic materials having metallic powder as the main component.

A blood-flow promoter can be used in at least the nasal area warmth-maintenance portion 3. In this case, a "blood-flow promoter" refers to a physiologically safe substance, volatile components of which penetrate into the skin and promote blood flow in the capillaries, and as examples, methyl salicylate, camphor, menthols various fragrant oils, cypress oil, cypress leaf oil, and tincture of chili peppers may be given. These substances may also irritate the eyes or the skin, so care should be taken when determining the location of use and amount of use. If an appropriate amount of the substance is used in a chosen location, the mask maintaining warmth in the nasal area 1 when worn, not only maintains warmth, but also prevents cooling of the nasal cavity and the sinuses over a long period of time due to the gradual action of the blood-flow promoters.

These blood-flow promoters may be dissolved, dispersed, or suspended in water or an organic medium, and combined into the nasal area warmth-maintenance portion 3 and the entirety or a portion of the main body 2, if necessary, by impregnation or coating. The volatility of these blood-flow promoters can be adjusted according to commonly-known methods such as dispersing the substances within a polyvinyl alcohol or gelatin film, or by forming them into microcapsules.

A magnet may be used in at least the nasal area warmth-maintenance portion 3. The magnetic force of the magnet acts on capillaries below the skin and promotes blood flow. Therefore, a mask maintaining warmth in the nasal area 1 using this magnet, when worn, not only maintains warmth, but also prevents cooling of the nasal cavity and the sinuses over a long period of time due to the gradual blood flow promotion action.

This magnet can be combined into the nasal area warmth-maintenance portion 3 and the entirety or a portion of the main body 2, if necessary, by powdering, and performing methods similar to those for the above-mentioned case with the far-infrared radiative materials.

The allowable magnetic flux density is not restricted, but a range of 800~1200 gauss is preferable.

In the mask maintaining warmth in the nasal area 1 of the present invention, there may be situations in which the nasal area warmth-maintenance portion 3 slips down when worn during active exercise, causing the nasal area n and its surroundings to become partially exposed. In order to prevent this situation, an adhesive layer can be formed on the inside surface of at least the nasal area warmth-maintenance portion 3 to adhere it to the nasal area n. It is preferable that this adhesive layer be formed on the entire inside surface of the nasal area warmth-maintenance portion 3 or a portion of the side surface. If the adhesive layer is formed as a ring around the perimeter of the nasal area warmth-maintenance portion 3, when worn, the warmth-maintenance effect increases because a retentive air pocket is formed between the nasal area warmth-maintenance portion 3 and the nasal area n.

This adhesive layer is formed from materials which adhere to, but do not irritate, the skin. Various types of adhesives may be used to form the adhesive layer. For example, commonly-known adhesives, such as those used in adhesive bandages, sodium polyacrylate, adhesive tape, or adhesive gel can be used.

It is possible to form the entirety of the nasal area warmth-maintenance portion 3 from an adhesive gel, then cover the outer surface with a plastic sheet or cellophane in order to make it non-adhesive.

With the mask maintaining warmth in the nasal area 1 of the present invention, it is preferable that a filter layer for collecting or filtering allergens be formed in the main body 2. This filter layer may be formed from a microfilter having microscopic pores, or from a layer of activated carbon, ion exchange resin, ceramics, or a static absorptive material. These types of filter layers are commonly known in the field. This filter layer can be removably inserted between the layers of the main body 2.

Figure 10:
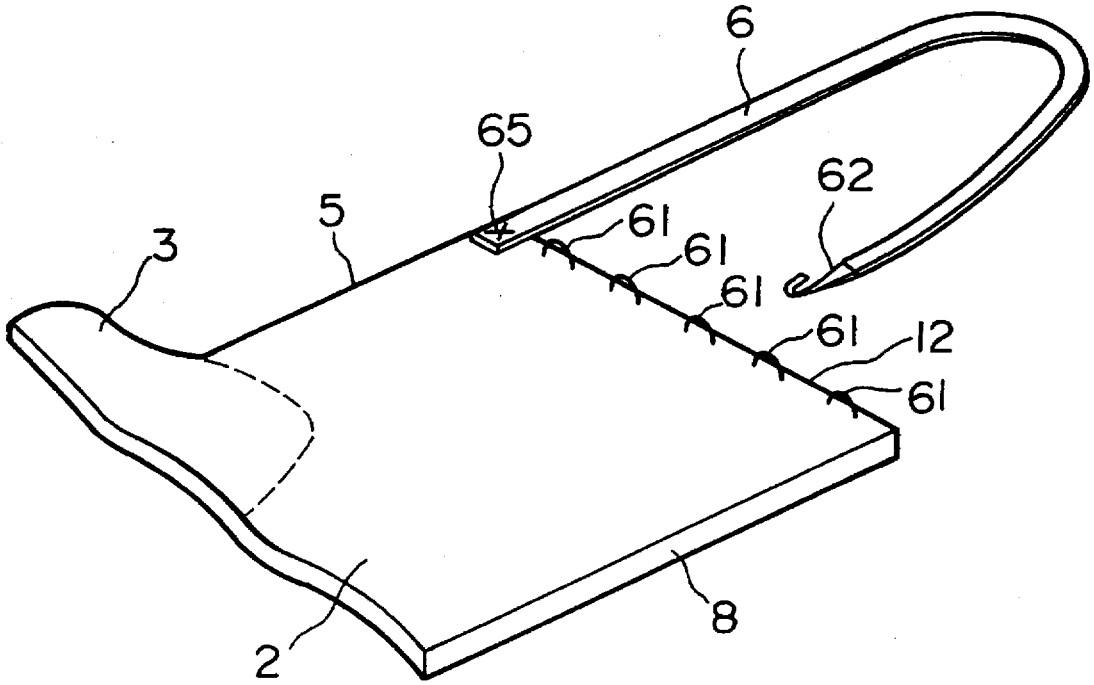
FIG. 10 is a diagram showing a modification of the strap of the mask maintaining warmth in the nasal area of the present invention.
Figure 11A:
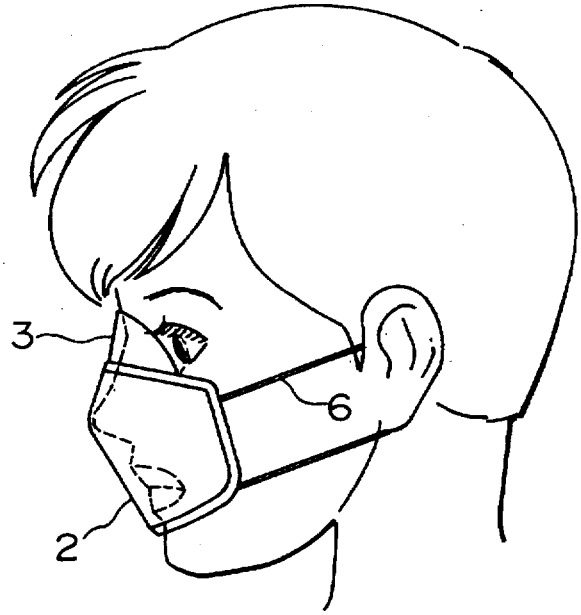
FIG. 11A is a diagram showing a state of wearing of the mask maintaining warmth in the nasal area when the attachment positions of the strap are wide apart.
Figure 11B:
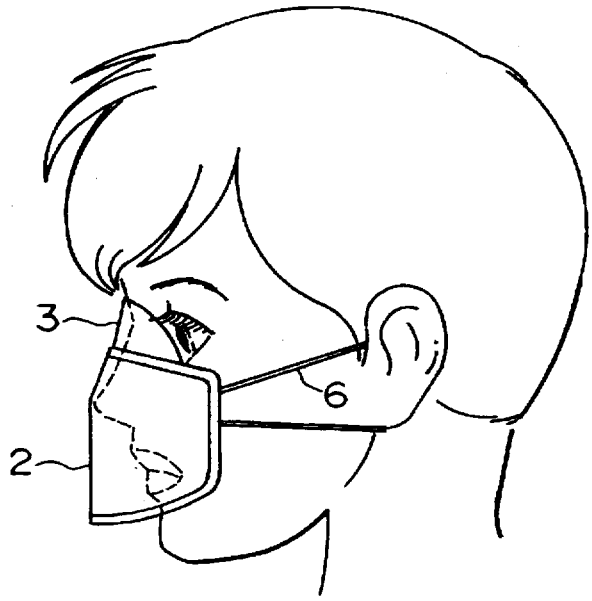
FIG. 11B is a diagram showing a state of wearing of the mask maintaining warmth in the nasal area when the attachment positions of the strap are close together.

In the above explanation, the straps 6 and 6 were attached to either end of both side portions 12 of the main body 2; however, it is possible to adjust the positions at which the straps are affixed to the main body. For example, as shown in FIG. 10, it is possible to affix one end of the straps 6 to an end 65 of the side portion 12 of the main body 2, and form a hook 62 on the other end of the strap 6, so that the hook is attachable to any of a plurality of loops 61 provided along the side portion 12. In this case, by adjusting the position at which the strap 6 is connected to the hook 62 depending on the size of the ears, it is possible to provide a mask maintaining warmth in the nasal area snugly fitting to any facial size from those of children to those of adults. Additionally, even when used by a single person, it is possible to change the style of fit to the facial surface by adjusting the positions of the straps, as shown in FIGS. 11A and 11B. For example, if the allergen inhalation prevention effect and the nasal area warming effect are both required, then both the main body 2 and the nasal area warmth-maintenance portion 3 can be held onto the facial surface by widening the spacing between the fixation portion of these straps 6 and 6 as shown in FIG. 11A. Alternatively, if only a nasal area warmth-maintenance effect is desired, then by holding down only the nasal area warmth-maintenance portion 3 by reducing the spacing between the fixation position of the straps 6 and 6 as shown in FIG. 11B, the nasal area will be suitably warmed, but the mouth and nasal cavity will be opened, making it easier to breathe.

The mask maintaining warmth in the nasal area of the present invention is characterized in that it prevents or relieves the symptoms of hay fever by maintaining or adding warmth by covering the upper portion of the nasal area with at least a nasal area warmth maintenance portion 3. Therefore, as long as this characteristic is satisfied many different modifications of the mask maintaining warmth in the nasal area of the present invention are possible.

For example, the mask maintaining warmth in the nasal area of the present invention can cover the nostrils but leave the mouth bare when worn, as shown in FIG. 16A. However, this mask maintaining warmth in the nasal area has at least one horizontal rib ($P_1$, $P_2$ and $P_3$ in the diagram) perpendicular to the center line Y of the main body 2. It is desirable that by spreading these ribs, the main body 2 can be made to cover both the nostrils and the mouth as shown in FIG. 16B. That is, with this mask maintaining warmth in the nasal area, the lower end portion 8 of the main body 2 is positioned between the upper lip and the nostrils when the ribs are folded, and the lower end portion 8 is positioned at least below the lower lip when the ribs are spread. When this mask maintaining warmth in the nasal area is worn with the ribs folded, while the nasal area warmth maintenance effect and the blockage of the intrusion of allergens and cold air into the nasal cavity are kept, the mouth is left bare so that there is no difficulty in breathing and it is possible to speak normally without the voice being muffled by the mask. Additionally, in the case in which women wear the mask, there is no worry that the mask could become smeared with lipstick, so it is possible to more comfortably wear the mask maintaining warmth in the nasal area while preserving the nasal area warmth maintenance effect. On the other hand, if the mouth needs to be covered in order to prevent the intrusion of bacteria through the mouth, the ribs can be spread as shown in FIG. 16B. Furthermore, it is desirable that, in addition to embedding a metallic wire 11 along the upper portion 5 of the main body 2, a second metallic wire 21 be embedded at a position corresponding to the end of the nose when worn. With the provision of two metallic wires in this manner, by pressing this mask maintaining warmth in the nasal area onto the face, the attachment to the nasal area improves and the warmth maintenance effect is improved.

Additionally, the mask maintaining warmth in the nasal area of the present invention can leave both the mouth and the nostrils bare when worn, as shown in FIG. 17A. However, in this case also, the mask maintaining warmth in the nasal area 1 has at least one horizontal rib (P in the diagram) perpendicular to the center line Y of the main body 2. It is desirable that the main body 2 be able to cover the nostrils by spreading these ribs, as shown in FIG. 17B. That is, with this mask maintaining warmth in the nasal area, the lower end portion 8 of the main body 2 is positioned at the end of the nose when the ribs are folded, and the lower end portion 8 is positioned so as to cover at least the nostrils when the ribs are spread. When this mask maintaining warmth in the nasal area is worn with the ribs folded, while the warmth maintenance effect in the nasal area is preserved, it is comfortable, with no difficulty in breathing, because the nostrils and the mouth are left bare. Additionally, when the ribs are spread, an effect identical to the previous example of the mask maintaining warmth in the nasal area when the ribs are folded is able to be obtained. With this mask maintaining warmth in the nasal area, similar to the previous example, it is desirable that two metallic wires 11 and 21 be embedded in the main body 2. Of course, it has been proven that sufficient prevention and relief of the symptoms of allergic nasal inflammation and hay fever can be obtained with only this nasal area warmth maintenance.

Figure 12:
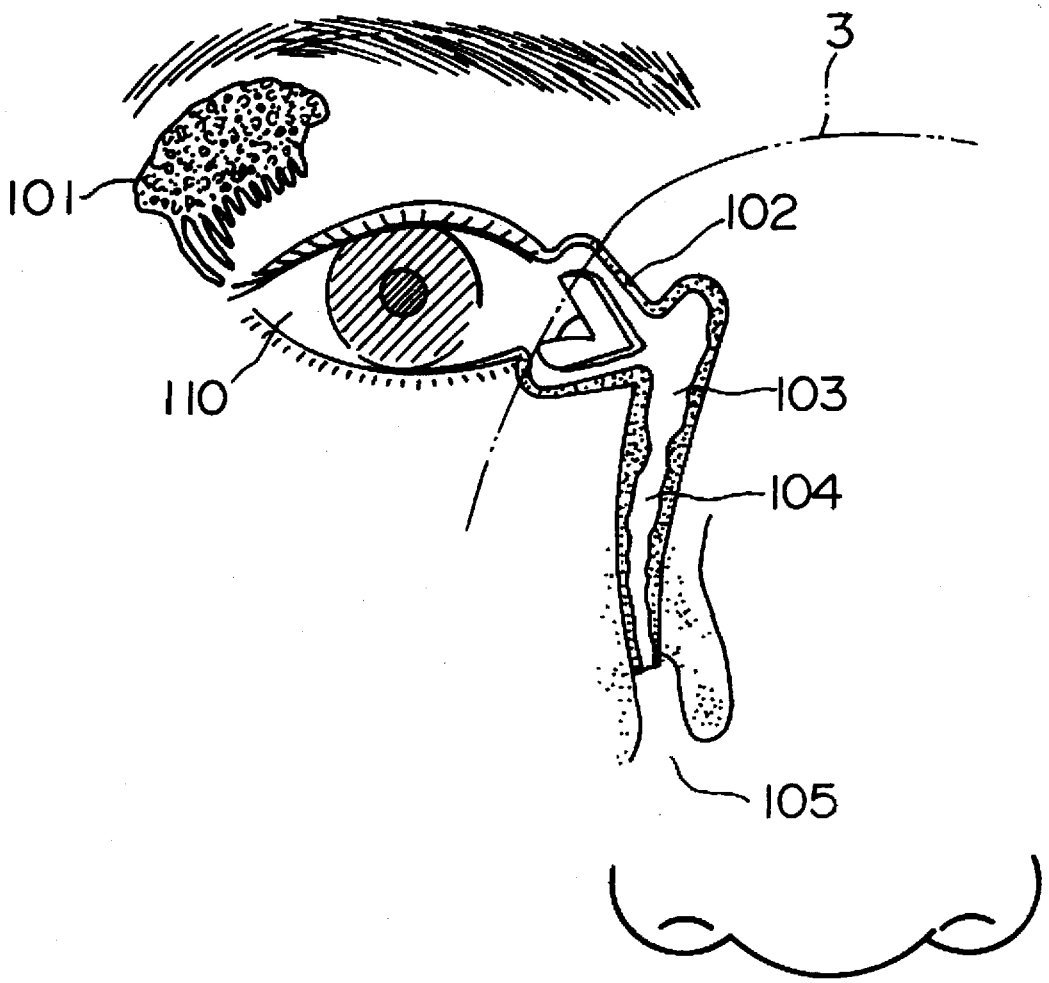
FIG. 12 is a schematic illustration of the tear-producing organs.

Furthermore, with the mask maintaining warmth in the nasal area 1 of the present invention, the nasal area warmth-maintenance portion covers at least the top portion of the nasal area; however, this nasal area warmth-maintenance portion can be enlarged to warm the area surrounding the top portion of the nose, such as the area around the eyes. For example, with hay fever, in addition to symptoms affecting the nose such as sneezing or congestion, the occurrence of other symptoms such as blood-shot eyes or itching of the eyes is also common. FIG. 12 is a simplified drawing showing the tear ducts in the area around the eyes. Normally, tears secreted by the tear glands 101 are continuously washing the surface of the eyeball 110, and the tears flow through the lachrymal ducts 102, through the tear sac 103 and the nasolachrymal canal 104 to the inferior nasal canal 105. However, when allergic reactions such as hay fever occur, the nasal membranes of the tear sac, lachrymal duct, and nasolachrymal canal become inflamed and block the passages, making it difficult for tears to flow, contributing to the occurrence of allergic reactions. Therefore, with the mask maintaining warmth in the nasal area of the present invention, by warming or heating the area surrounding the tear ducts, it is expected that these types of symptoms can be eliminated, relieved, or prevented. For example, it is preferable that the nasal area warmth-maintenance portion 3 of the mask maintaining warmth in the nasal area of the present invention cover the parts of the face corresponding to the lachrymal canals as shown by the dotted line in the drawing. In practice, when patients suffering from allergic symptoms in the eyes or the mask maintaining warmth in the nasal area of the present invention in the area around the lachrymal ducts was warmed, examples were observed wherein the symptoms were relieved. For example, when a patient who had suffered from hay fever for 15 years wore the mask maintaining warmth in the nasal area of the present invention, the symptoms occurring in the nose and the eyes were relieved or eliminated. Therefore, the mask maintaining warmth in the nasal area of the present invention is effective in relieving or eliminating allergic symptoms occurring in the tear apparatus.

As explained above, the mask maintaining warmth in the nasal area of the present invention is characterized in covering and maintaining or adding warmth to the upper portion of the nasal area. Therefore, a nasal area warmth maintenance device 30 as shown in FIGS. 18A and 18B are also included within the scope of the present invention.

This nasal area warmth maintenance device 30 allows attachment to the face of only the nasal area warmth maintenance portion of the mask maintaining warmth in the nasal area of the present invention. Therefore, this nasal area warmth maintenance device 30 is formed from a flexible warmth maintaining sheet 31 with an adhesive layer 32 on one side, having a shape so as to allow coverage of at least the nasal cavity or both the nasal cavity and sinuses. This warmth maintaining sheet 31 can be flat, or can be preformed into a shape conforming to the shape of the nasal area.

This warmth maintaining sheet 31 should preferably be formed from one, or a layering of at least two of materials chosen from the group consisting of woven cloth, knitted cloth, unwoven cloth, felt, paper, cotton, plastic, foam plastic, rubber, foam rubber, sponge, natural leather, synthetic leather, artificial skin and metallic foil. More specifically, woven cloth, knitted cloth, unwoven cloth, gauze, thin paper such as tissue paper, or the layering thereof; the layering of a layer of material having high air-holding capability such as gauze or degreased cotton; or a layered body including at least one of the group consisting of plastic, foam plastic, rubber, foam rubber, sponge, metallic foil, natural leather, synthetic leather, or artificial skin made from collagen or polyglutamates may be suggested. The heat conductivity of this warmth maintaining sheet 31 should preferably be less than $1\times10^{-3}$ cal/cm·sec·° C.

Additionally, the adhesive layer 32 formed on one side of the warmth maintaining sheet 31 should be formed from a material which adheres to but does not irritate the skin. Many different types of adhesive materials can be used to form this adhesive layer 32, but some possible examples are common adhesives such as those used in adhesive bandages, sodium polyacrylate, adhesive tape, or adhesive gels.

FIG. 19 shows this nasal area warmth maintenance device 30 as worn over the nasal area. Since this nasal area warmth maintenance device 30 is completely uncovered, it is desirable that at least the outer surface of the warmth maintaining sheet 31 be skin-colored or the warmth maintaining sheet 31 be transparent. Additionally, many different types of materials can be combined into this warmth maintaining sheet 31, similar to the above-mentioned nasal area warmth maintenance portion of the mask maintaining warmth in the nasal area. For example, the warmth maintenance and heating effects can be improved by including metallic foil, far-infrared materials, heat-releasing materials having iron powder or calcium oxide as the main component, blood flow promoters or magnets. Additionally, by providing irregularities on the inside of the warmth maintaining sheet 31 with a raising procedure, it is also possible to improve the warmth maintenance effect.

By wearing this nasal area warmth maintenance device 30, it is possible to maintain or add warmth to at least the upper portion of the nasal area, without obstructing the nasal cavity or the mouth. Furthermore, there is no aversion to wear because the mask is not placed over the ears, and the field of view is not blocked.

Next, some examples are given in order to explain the mask maintaining warmth in the nasal area of the present invention in further detail.

EXAMPLES

Test Example

Here, Test Examples are explained which indicate that allergic reactions in the nasal area due to hay fever or the like can be prevented, relieved, or eliminated by maintaining or adding warmth to the nasal area.

Test Subjects: Subjects A and B are sufferers of hay fever. Subject N is a physically healthy individual who does not suffer from the symptoms of hay fever.

On Apr. 12, 1993, which is the time of year at which hay fever is likely to occur, the facial temperature distributions of Subjects A, B, and N were measured by thermography. At this time, Subjects A and B showed the symptoms of hay fever.

Figure 13:
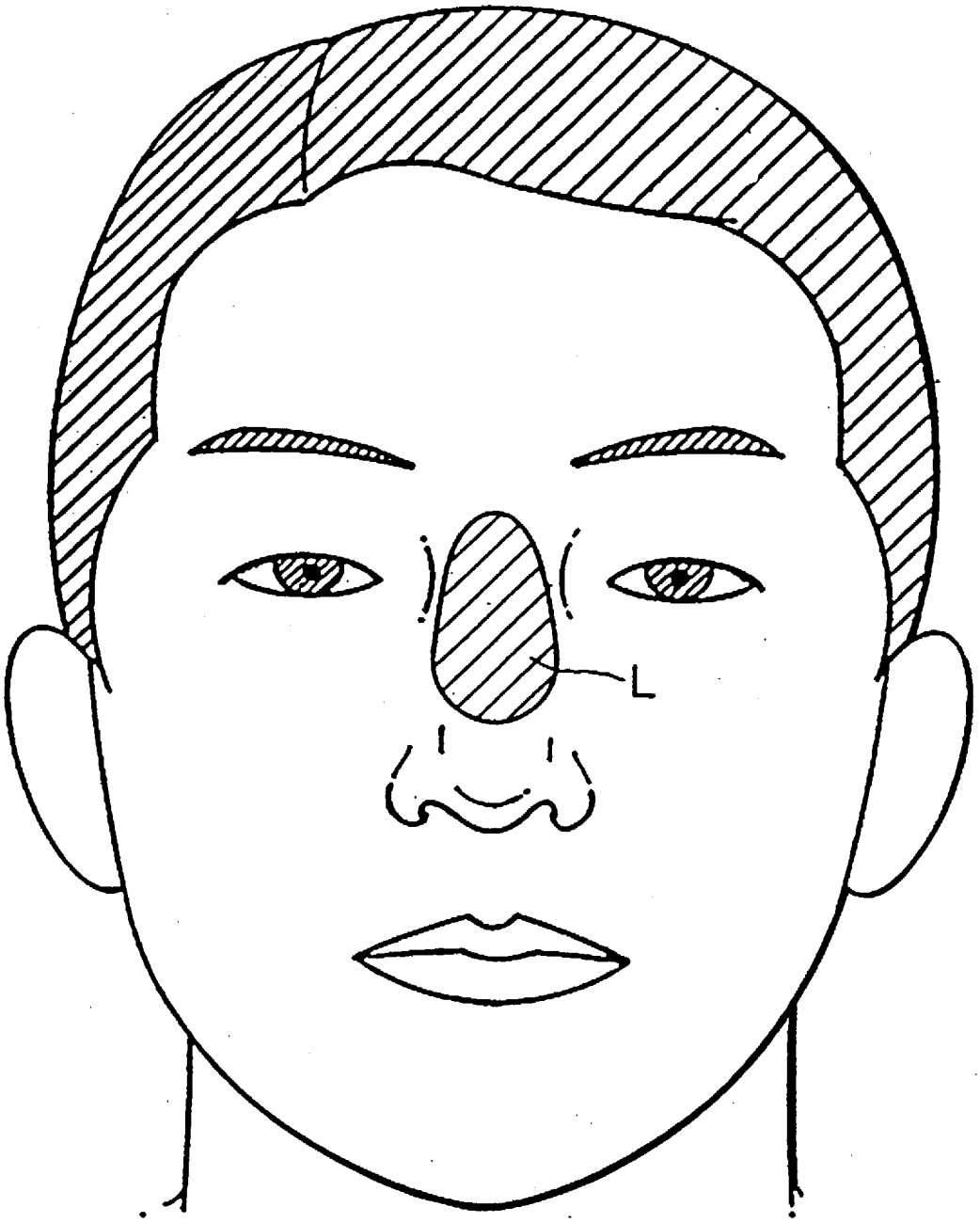
FIG. 13 is a front view of the face showing a test example of a thermograph.

In the results, whereas the entire facial surface of Subject N was displayed in a uniform orange color in the thermograph, in the case of Subjects A and B, the top portion of the nasal area as indicated by reference symbol L in FIG. 13 were green in the thermograph, which indicates a low temperature, while the rest of the face was orange. This result indicates that the upper portion of the nasal area L of Subjects A and B have low temperatures in comparison with the rest of the face, and the top portion of the nasal area of Subject N.

At this time, the body temperature of Subject A was 37.5° C., while the temperature of the upper portion of the nasal area L was 34.0°~34.5° C., and the temperature of the cheek area beneath the eyes was 35.9°~36.3° C., as measured by a surface thermometer.

Next, a heated iron powder-type warming material (Japanese product name: "Hokaron") was applied to the upper portion of the nasal area L of Subject A, and after 10 minutes of warming, the warming material was disposed of, at which time the temperature of the upper portion of the nasal area L was measured at 43.5 °~45.0° C. During warming, the symptoms of hay fever disappeared. Additionally, when the temperature of the upper portion of the nasal area L was allowed to cool, the symptoms returned, and when the upper portion of the nasal area L was re-warmed, the symptoms once again disappeared.

From the above results, it is apparent that in sufferers of allergic nasal inflammation due to hay fever and the like, the temperature in the nasal area and its surroundings is lower than in healthy people, and when allergens are allowed to irritate the nasal membrane in this condition, symptoms can occur. These symptoms can be prevented, relieved, or eliminated by maintaining or adding warmth to the nasal area and its surroundings.

Example 1

The mask maintaining warmth in the nasal area 1 as shown in FIG. 1 was produced. This mask maintaining warmth in the nasal area 1 was made by sewing the lower end portion 7 of a nasal area warmth-maintenance portion 3, made from skin-colored felt and pre-formed into a three-dimensional shape so as to cover the nasal area n and its surroundings when worn, to the central portion of a main body 2 made from a layered gauze sheet having 12 layers having the shape of a rectangle of width 90 mm and length 135 mm. A flattened metal wire 11 was embedded along the upper portion 5 of the main body 2, and the side portions 12 and 12 of the main body 2 were formed in the shape of a loop, so that the respective straps 6 and 6 could be inserted into the loops and tied thereto.

The nasal area warmth-maintenance portion 3 has the shape of an inverted T, having a length of 35 mm in the direction along the nasal ridge (the vertical direction), a maximum horizontal length of 80 mm and a thickness of 1 mm. When the mask maintaining warmth in the nasal area is worn over the face and the nasal area warmth-maintenance portion 3 is fitted over the nasal area n, then the upper end portion 4 of the nasal area warmth-maintenance portion 3 protrudes approximately 20 mm above the upper portion 5 of the main body 2.

This nasal area warmth-maintenance portion 3 is made in a three-dimensional shape from a felt sheet.

When the mask maintaining warmth in the nasal area 1 of Example 1 was worn with the side having the nasal area warmth-maintenance portion 3 contacting the face and the straps 6 lain over the ears in a manner similar to a normal mask, then the metallic wire 11 bent to conform to the shape of the facial surface, the nasal area warmth-maintenance portion 3 could solidly cover the nasal area and its surroundings and effectively warm the area. Additionally, the field of view was not obstructed.

Application Test 1

A test of the application of the mask maintaining warmth in the nasal area of Example 1 was carried out. The test Subjects were Subjects A, B, and C, all of whom suffer from hay fever. From February to April, which is the period in which hay fever occurs, while each test subject went through the subject's respective normal daily routine, the severity of the symptoms was measured for time periods in which the mask maintaining warmth in the nasal area of Example 1 was worn, and for time periods in which it was not worn, with the time periods recorded in units of 1 hour. Of course, the mask was not worn during periods of sleep. The severity of the symptoms is represented by the number of times the nose was blown during each time period. The results of the first test of Subject A are recorded in Table 1, the results of the second test in Table 2, and the results of the third test in Table 3.

Additionally, the test results of Subject B are recorded in Table 4 and those of Subject C are recorded in Table 5. In the row marked "Condition" in the Tables below, a "O" indicates that a mask was worn, an "X" indicates that a mask was not worn, and a "Δ" indicates that the subject was asleep and a "-" indicates that no measurement was taken. The "Action" row indicates the number of times the nose was blown.

Table 1:

Test Date: 5 Mar. 1994

Weather: Cloudy

Test Subject: A

Test Object: Mask Maintaining Warmth in the Nasal Area (Example 1)

TABLE 1

| Time | 5 | 6 | 7 | 8 | 9 | 10 | 11 | 12 | 13 | 14 | 15 | 16 | 17 | 18 | 19 | 20 | 21 | 22 |
|---|---|---|---|---|---|---|---|---|---|---|---|---|---|---|---|---|---|---|
| Condi-tion | Δ | Δ | Δ | Δ | X | X | X | X | ○ | ○ | ○ | ○ | ○ | ○ | ○ | ○ | ○ | Δ |
| Action | 0 | 0 | 0 | 0 | 10 | 9 | 7 | 10 | 2 | 1 | 0 | 1 | 0 | 0 | 0 | 0 | 0 | 0 |
| Location | H | H | H | H | H | H | H | OD | OD | OD | OD | H | H | H | H | H | H | H |

J = At home, OD = Outdoors

Table 2:

Test Date: 10 Mar. 1994

Weather: Cloudy

Test Subject: A

Test Object: Mask Maintaining Warmth in the Nasal Area (Example 1)

TABLE 2

| Time | 5 | 6 | 7 | 8 | 9 | 10 | 11 | 12 | 13 | 14 | 15 | 16 | 17 | 18 | 19 | 20 | 21 | 22 |
|---|---|---|---|---|---|---|---|---|---|---|---|---|---|---|---|---|---|---|
| Condi-tion | Δ | X | X | X | X | ○ | ○ | ○ | X | ○ | ○ | ○ | ○ | ○ | X | X | ○ | ○ |
| Action | 0 | 5 | 3 | 1 | 7 | 1 | 0 | 0 | 5 | 1 | 0 | 0 | 0 | 0 | 0 | 0 | 1 | 0 |
| Location | H | H | TR | OF | OF | OF | OF | OF | OF | OF | OF | OF | OF | OF | TR | TR | H | H |

H = At home, TR = In a train, OF = In an office

Table 3:

Test Date: 6 Apr. 1994

Weather: Fair

Test Subject: A

Test Object: Mask Maintaining Warmth in the Nasal Area (Example 1)

TABLE 3

| Time | 5 | 6 | 7 | 8 | 9 | 10 | 11 | 12 | 13 | 14 | 15 | 16 | 17 | 18 | 19 | 20 | 21 | 22 |
|---|---|---|---|---|---|---|---|---|---|---|---|---|---|---|---|---|---|---|
| Condi-tion | Δ | Δ | Δ | Δ | X | X | X | X | X | X | X | ○ | ○ | ○ | ○ | ○ | ○ | ○ |
| Action | 0 | 0 | 0 | 0 | 15 | 5 | 13 | 8 | 11 | 25 | 30 | 0 | 0 | 0 | 0 | 0 | 0 | 0 |
| Location | H | H | H | H | H | H | OD | OD | TR | FI | FI | FI | TR | H | H | H | H | H |

H = At home, OD = Outdoors, TR = In a train, FI = In a field

Table 4:

Test Date: 27 Mar. 1994

Weather: Sunny

Test Subject: B

Test Object: Mask Maintaining Warmth in the Nasal Area (Example 1)

TABLE 4

| Time | 5 | 6 | 7 | 8 | 9 | 10 | 11 | 12 | 13 | 14 | 15 | 16 | 17 | 18 | 19 | 20 | 21 | 22 |
|---|---|---|---|---|---|---|---|---|---|---|---|---|---|---|---|---|---|---|
| Condi-tion | — | — | — | — | — | — | X | ○ | X | X | X | ○ | X | X | X | X | X | X |
| Action | | | | | | | 5 | 0 | 0 | 2 | 1 | 0 | 0 | 3 | 2 | 0 | 0 | 0 |
| Location | | | | | | | H | H | H | H | H | H | H | H | H | H | H | H |

H = At home

Table 5:

Test Date: 9 Feb. 1994

Weather: Cloudy

Test Subject: C

Test Object: Mask Maintaining Warmth in the Nasal Area (Example 1)

TABLE 5

| Time | 5 | 6 | 7 | 8 | 9 | 10 | 11 | 12 | 13 | 14 | 15 | 16 | 17 | 18 | 19 | 20 | 21 | 22 |
|---|---|---|---|---|---|---|---|---|---|---|---|---|---|---|---|---|---|---|
| Condition | — | — | — | X | X | ○ | ○ | ○ | X | X | — | — | — | — | — | — | — | — |
| Action | | | | 7 | 8 | 1 | 0 | 0 | 0 | 0 | | | | | | | | |
| Location | | | | OF | OF | OF | OF | OF | OF | OF | | | | | | | | |

OF = In an office

Comparative Example 1

The day after Subject A performed the first test, under approximately the same conditions, the test was repeated using a commercially-available pollen-proof gauze mask (having a filter) instead of the mask maintaining warmth in the nasal area of Example 1. The results are shown in Table 6.

Table 6:

Test Date: 6 Mar. 1994

Weather: Cloudy

Test Subject: A

Test Object: Commercially Available Anti-pollen Mask (Comparative Example)

TABLE 6

| Time | 5 | 6 | 7 | 8 | 9 | 10 | 11 | 12 | 13 | 14 | 15 | 16 | 17 | 18 | 19 | 20 | 21 | 22 |
|---|---|---|---|---|---|---|---|---|---|---|---|---|---|---|---|---|---|---|
| Condition | Δ | Δ | Δ | Δ | X | X | X | X | ○ | ○ | ○ | ○ | ○ | ○ | ○ | ○ | Δ | Δ |
| Action | 0 | 0 | 0 | 0 | 17 | 10 | 5 | 8 | 3 | 5 | 3 | 2 | 5 | 1 | 2 | 3 | 0 | 0 |
| Location | H | H | H | H | H | H | H | OD | OD | OD | OD | OD | OD | H | H | H | H | H |

H = At home, OD = Outdoors

Since the cedar pollen levels for the year 1994 were within 10~20% of the normal level, the symptoms in Subjects A, B, and C were light. However, as is apparent from the results shown in Tables 1~5, there is a remarkable difference in the number of times the nose was blown between the times in which the mask maintaining warmth in the nasal area of Example 1 was worn and the times in which such a mask was not worn, for all subjects in all locations except during times of sleep, and it is clear that this mask maintaining warmth in the nasal area prevents, relieves, or eliminates the occurrence of symptoms of hay fever.

Referring to the Comparative Example shown in Table 6, it can be confirmed that the mask maintaining warmth in the nasal area of Example 1 is remarkably effective in comparison to conventional masks.

Application Test 2

A severe application test was performed on the mask maintaining warmth in the nasal area 1 of Example 1. Specifically, at 10:00 a.m. during his daily routine, Subject A voluntarily inhaled a large quantity of cedar pollen from a plastic bag. In the following hour, the severity of the symptoms was observed without the mask maintaining warmth in the nasal area 1 being worn.

After 2 to 3 minutes, sneezing began, the nose began to run uncontrollably, the nasal membranes became swollen, pain was experienced, and eventually, both nasal cavities became completely congested.

At 11:00 a.m., the mask was donned, and the subsequent conditions observed. The test results are shown in Table 7.

Table 7:

Test Date: 11 Mar. 1994

Test Subject: A

Test Object: Mask Maintaining Warmth in the Nasal Area (Example 1)

TABLE 7

| Time | 5 | 6 | 7 | 8 | 9 | 10 | 11 | 12 | 13 | 14 | 15 | 16 | 17 | 18 | 19 | 20 | 21 | 22 |
|---|---|---|---|---|---|---|---|---|---|---|---|---|---|---|---|---|---|---|
| Condition | Δ | X | X | X | X | X | ○ | ○ | ○ | ○ | ○ | ○ | X | ○ | ○ | X | X | ○ |
| Action | 0 | 5 | 2 | 1 | 1 | 97 | 15 | 5 | 6 | 2 | 1 | 2 | 17 | 3 | 2 | 3 | 5 | 0 |
| Location | H | H | TR | TR | OF | OF | OF | OF | OF | OF | OF | OF | TR | TR | H | H | H | H |
| Symptoms | | | | | | (1) | (2) | (3) | (4) | (5) | (6) | (7) | | | | | | |

Location: H = At home, TR = In a train, OF = In an office
Symptoms: (1) Inhalation of cedar pollen
(2) Both nasal cavities congested
(3) Congestion somewhat relieved
(4) Same as above
(5) Congestion reduced
(6) Nasal membrance still swollen
(7) Same as above From the results of the severe test shown in Table 7, it is possible to see that wearing the mask maintaining warmth in the nasal area quickly relieves the harsh symptoms of pollen inhalation.

Application Test 3

Figure 14:
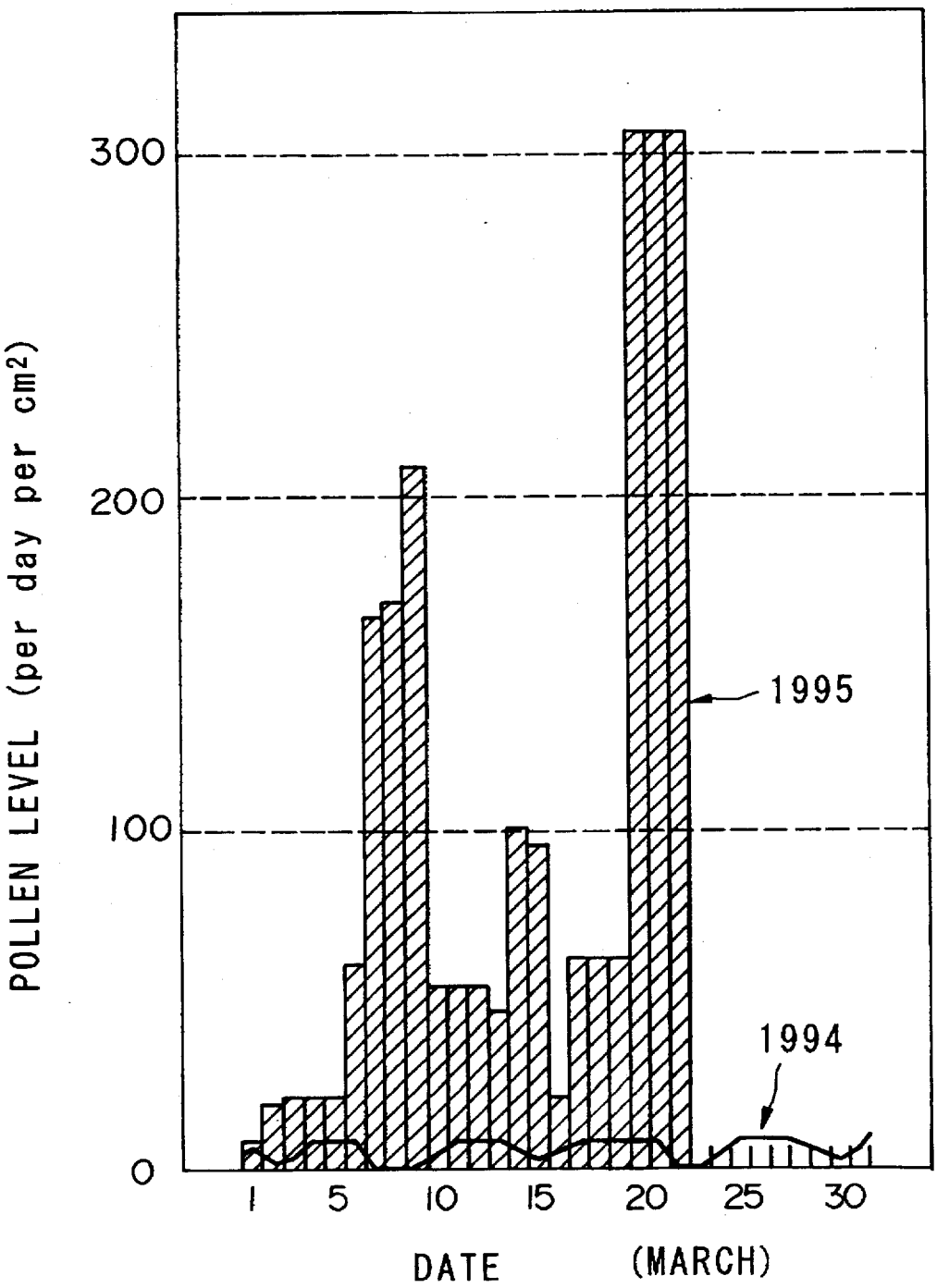
FIG. 14 is a graph showing the concentration of pollen in March 1994 and March 1995 (in Chiyoda Ward in central Tokyo, Japan).

FIG. 14 is a graph showing the pollen levels as measured in Chiyoda Ward in central Tokyo, Japan, in March 1994 and March 1~22, 1995. As seen in FIG. 14, the pollen level in March 1995 increased dramatically in comparison with the levels in 1994. Under these conditions, a test identical to Application Test 1 was performed on the mask maintaining warmth in the nasal area 1 of Example 1. The wearer of the mask was test Subject A who suffers from hay fever. The results are shown in Tables 8~10.

Table 8:

Test Date: 20 March 1995

Weather: Fair

Test Subject: A

Test Object: Mask Maintaining Warmth in the Nasal Area (Example 1)

TABLE 8

| Time | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|---|---|
| Condition | X | X | X | X | X | X | X | ○ | ○ | ○ | ○ | ○ | X | X | ○ | ○ | ○ | ○ | ○ | ○ | X | X | X | ○ |
| Action | 0 | 0 | 0 | 0 | 2 | 1 | 55 | 7 | 5 | 5 | 3 | 0 | 10 | 15 | 0 | 0 | 0 | 0 | 0 | 0 | 0 | 0 | 17 | 0 |
| Location and Notes | S | S | S | S | S T | S | H W | TR | TR | ID | ID | ID | OD | ID | ID | ID | ID | ID | TR | TR | H | H B | H | S R |

S = Sleeping, T = Toilet, W = Waking, ID = Indoors, OD = Outdoors, H = At home, TR = In a train, B = Bathing, R = Retiring to bed Table 9:

Test Date: 21 Mar. 1995

Weather: Fair

Test Subject: A

Test Object: Mask Maintaining Warmth in the Nasal Area (Example 1)

TABLE 9

| Time | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|---|---|
| Condition | ○ | ○ | ○ | ○ | ○ | ○ | X | ○ | ○ | ○ | ○ | ○ | X | X | ○ | ○ | ○ | ○ | ○ | X | X | ○ | ○ | ○ |
| Action | 0 | 0 | 0 | 0 | 0 | 0 | 3 | 0 | 0 | 0 | 4 | 3 | 0 | 10 | 0 | 0 | 0 | 0 | 0 | 0 | 29 | 20 | 25 | 0 |
| Location and Notes | S | S | S | S | S | S | H W | H | H | H | TR | TR | ID | OD | OD | OD | OD | OD | AU | H B | H | H | H | S R |

S = Sleeping, W = Waking, ID = Indoors, OD = Outdoors, H = At home, TR = In a train, AU = Automobile, B = Bathing, R = Retiring to bed Table 10:

Test Date: 22 Mar. 1995

Weather: Fair

Test Subject: A

Test Object: Mask Maintaining Warmth in the Nasal Area (Example 1)

TABLE 10

| Time | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|---|---|
| Condition | ○ | ○ | ○ | ○ | ○ | ○ | X | ○ | ○ | ○ | ○ | ○ | X | X | ○ | ○ | ○ | ○ | ○ | ○ | ○ | ○ | ○ | X |
| Action | 0 | 0 | 0 | 0 | 0 | 0 | 3 | 2 | 7 | 2 | 0 | 0 | 0 | 1 | 0 | 0 | 0 | 0 | 0 | 0 | 0 | 0 | 0 | 0 |
| Location and Notes | S | S | S | S | S | S | H W | TR | TR | ID | ID | ID | ID | ID | OD | OD | OD | OD | ID | ID | ID | TR | TR | H B R |

S = Sleeping, W = Waking, ID = Indoors, OD = Outdoors, H = At home, TR = In a train, B = Bathing, R = Retiring to bed Comparative Example 2

The day before Subject A performed the first test, under approximately the same conditions, the same application test was performed using a commercially-available gauze mask (with activated carbon) instead of the mask maintaining warmth in the nasal area 1 of Example 1. The results are shown in Table 11.

Table 11:

Test Date: 19 Mar. 1995

Weather: Rainy

Test Subject: A

Test Object: Commercially Available Gauze Mask (Comparative Example)

TABLE 11

| Time | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|---|---|
| Condition | X | X | X | X | X | X | X | O | O | O | O | O | X | X | X | O | O | O | O | O | X | X | X | X |
| Action | 0 | 0 | 0 | 0 | 0 | 0 | 62 | 28 | 25 | 55 | 45 | 30 | 60 | 25 | 28 | 30 | 33 | 54 | 28 | 35 | 7 | 4 | 5 | 0 |
| Location and Notes | S | S | S | S | S | S | H W | TR | TR | ID | ID | ID | ID | ID | ID | ID | ID | ID | TR | TR | H | H | H B | S R |

S = Sleeping, W = Waking, ID = Indoors, H = At home, TR = In a train, B = Bathing, R = Retiring to bed As is apparent from the above results, the number of times the nose was blown between the times at which the mask maintaining warmth in the nasal area of the present invention was worn and the times at which it was not worn is remarkable, and it is clear that this mask maintaining warmth in the nasal area prevents, relieves, or eliminates the occurrence of allergic symptoms of hay fever. Additionally, with reference to the Comparative Example shown in Table 11, it was confirmed that the mask maintaining warmth in the nasal area of the present invention was more effective than a conventional mask. Furthermore, a tendency of the symptoms which had been suppressed by the mask maintaining warmth in the nasal area of the present invention to return was observed when blood circulation was promoted by taking a bath. Additionally, when the mask maintaining warmth in the nasal area was worn during sleep, the symptoms after awakening were relieved in comparison with the case in which a mask was not worn. Also, in the above-mentioned application test, the effect of the mask maintaining warmth in the nasal area was evident after 1 to 5 minutes from the time at which the mask was donned for every test subject.

Example 2

The mask maintaining warmth in the nasal area 1 shown in FIG. 7 was produced. With this mask maintaining warmth in the nasal area 1, the nasal area warmth maintenance portion and the main body 2 are formed as a single body from a layered gauze sheet having 12 layers, with an upper end portion 4 protruding 20 mm along the vertical line X from the central portion 5 of the main body 2 which is formed in the shape of a rectangle of width 90 mm and length 135 mm.

This mask maintaining warmth in the nasal area 1 has 4 vertical ribs p1, p2, p3, and p4, formed parallel and symmetrical with respect to the center vertical line X, and the upper end of each rib is sewn and thereby affixed to the upper end portion 4, while the lower end of each rib is sewn and thereby affixed to the lower portion of the main body.

Additionally, a plastic ribbon 9 holding a single metallic wire made from mnematic alloy is embedded in the peripheral portion of the upper end portion 4, extending to the ends of both upper portions 5 and 5. This metallic wire formed from mnematic alloy is pre-formed so as remember a shape conforming to the facial features.

Loops allowing passage of the straps are formed on both side portions 12 and 12 of the main body 2, and the straps 6 for laying over the ears are inserted into the respective loops.

When the mask maintaining warmth in the nasal area 1 of FIG. 7 is worn, the nasal area warmth maintenance portion 3 bulges outwardly due to the protrusion of the nasal area, and the upper end portion 4 curves to conform to and solidly cover the upper portion of the nasal area. Furthermore, when the plastic ribbon 9 having the mnematic alloy is heated by the bodily warmth, the original shape returns, so that the upper end portion 4 automatically changes shape without manual shaping so as to solidly cover the upper portion of the nasal area and effectively maintain warmth in the nasal area and in its surroundings. This mask maintaining warmth in the nasal area 1 has a solid overall fit to the face, exhibits excellent warmth maintenance and dust-exclusion effects, and has an agreeable outward appearance.

Example 3

Figure 15A:
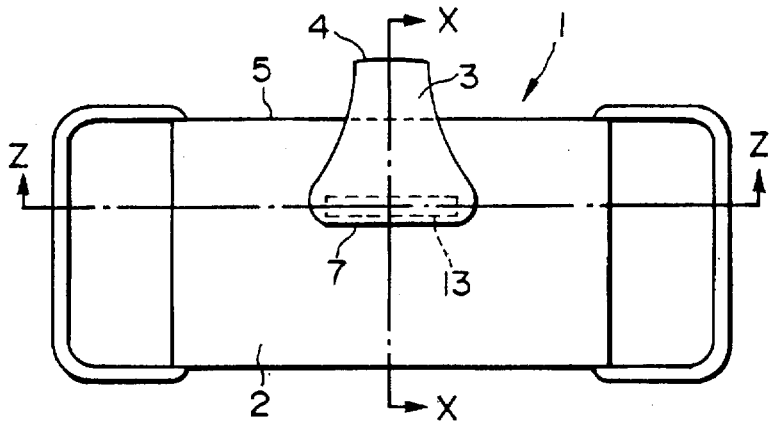
FIG. 15A is a front view of Example 3 of the mask maintaining warmth in the nasal area seen from the inside.
Figure 15B:
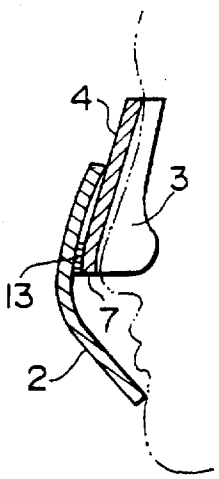
FIG. 15B is a sectional view along the line X—X of FIG. 15A.
Figure 15C:
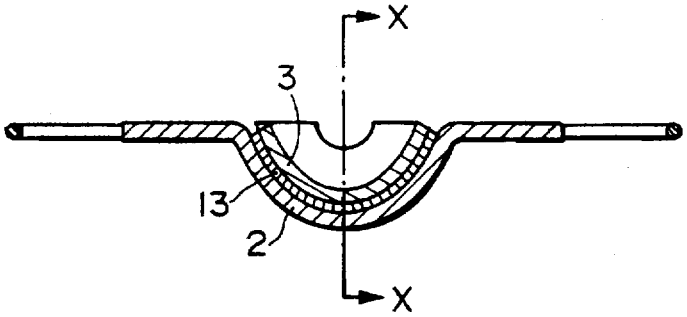
FIG. 15C is a sectional view along the line Z—Z of FIG. 15A.

The mask maintaining warmth in the nasal area 1 shown in FIG. 15 was produced. With the mask maintaining warmth in the nasal area, the nasal area warmth maintenance portion 3 and the main body 2 are formed separately. That is, a felt nasal area warmth maintenance portion 3 in the shape of the nasal area is attached by velcro 13 along the external side of the lower end portion 7 to the central portion of the main body 2 which is formed from a layered gauze sheet having 12 layers in the shape of a rectangle having a width of 90 mm and a length of 135 mm. Since the nasal area warmth maintenance portion 3 is attached by velcro 13, it can be removed or reattached to the main body 2 as necessary.

This nasal area warmth maintenance portion 3 is formed in the shape of an arch, the width of which gradually thins from the lower end portion 7 to the upper end portion 4, and on its interior surface, an unwoven cloth bag containing exothermic materials such as metallic powder and sodium chloride is attached. This exothermic material is affixed by an adhesive provided within the bag to prevent it from flowing.

When this mask maintaining warmth in the nasal area 1 is worn in a manner similar to a normal mask, with the side having the nasal area warmth-maintenance portion 3 on the inside, the upper end portion 4 is provided in a position to cover the upper portion of the nasal area because the nasal area warmth-maintenance portion 3 is formed in a three-dimensional shape to conform to the nasal area n. In this state, the exothermic material on the inside of the nasal area warmth-maintenance portion 3 is suitably heated, so that the nasal area and its surroundings are effectively warmed over a long period of time, eliminating the symptoms of hay fever.

Since the nasal area warmth-maintenance portion 3 is removably attached to the main body 2 by velcro 13, it is possible to adjust the length from the upper portion 5 of the main body to the upper end portion 4 of the nasal area warmth-maintenance portion from 10 mm to 25 mm. Therefore, by adjusting the position of the upper end portion 4 according to the facial features and dimensions of the wearer, a wide range of sufferers of allergic nasal inflammation, from children to adult men and women can use this mask maintaining warmth in the nasal area 1.

Additionally, it is possible to extend the heating time by removing the nasal area warmth-maintenance portion 3 after it has completed the radiation of heat, and replacing it with a new nasal area warmth-maintenance portion 3. Furthermore, it is possible to store spare nasal area warmth-maintenance portions 3 in vacuum-sealed packs.

If the nasal area warmth-maintenance portion is removably attached to the main body as in the present example, the main body can be separated from the nasal area warmth-maintenance portion and washed, replaced, or stored. Additionally, by adjusting the mutual positions of the main body and the nasal area warmth-maintenance portion to conform to the facial dimensions, it is possible to apply to a wide range of patients.

What is claimed is:

1. A mask maintaining warmth in a wearer's nasal area, said mask comprising:

a main body in the form of a sheet;

a nasal area warmth-maintenance portion disposed at a central portion of said main body and covering at least a wearer's nasal area, said nasal area warmth-maintenance portion having a number end portion for covering at least an upper portion of a wearer's nasal area said upper end portion being provided so as to protrude from an upper end portion of said main body, said nasal area warmth-maintenance portion for increasing the temperature of at least a portion of a human head; and straps for affixing said main body to a wearer's face wherein said main body has at least one horizontal rib positioned substantially perpendicular to a vertical line through a center of said mask maintaining warmth in a wearer's nasal area, and wherein a lower end portion of said main body is positioned between a wearer's upper lip and nostrils when the mask maintaining warmth in a wearer's nasal area is worn over a wearer's face with said horizontal ribs folded, and said lower end portion of said main body is positioned beneath a wearer's mouth when the mask maintaining warmth in a wearer's nasal area is worn over a wearer's face with said horizontal ribs spread.

2. A mask maintaining warmth in a wearer's nasal area, said mask comprising;

a main body in the form of a sheet;

a nasal area warmth-maintenance portion disposed at a central portion of said main body and covering at least a wearer's nasal area, said nasal area warmth-maintenance portion having an upper end portion for covering at least an upper portion of a wearer's nasal area, said upper end portion being provided so as to protrude from an upper end portion of said main body, said nasal area warmth-maintenance portion for increasing the temperature of at least a portion of a human head; and straps for affixing said main body to a wearer's face wherein said main body has at least one horizontal rib positioned substantially perpendicular to a vertical line through a center of said mask maintaining warmth in a wearer's nasal area, and wherein a lower end portion of said main body is positioned at an end of a wearer's nose when the mask maintaining warmth in a wearer's nasal area is worn over a wearer's face with said horizontal ribs folded, and said lower end portion of said main body is positioned between a wearer's upper lip and nostrils when the mask maintaining warmth in a wearer's nasal area is worn over a wearer's face with said horizontal ribs spread.

3. A mask maintaining warmth in the nasal area according to one of claims 1 and 2, wherein said nasal area warmth-maintenance portion and said main body are formed unitarily, and at least the upper end portion of the nasal area warmth-maintenance portion is able to be shaped three-dimensionally so as to be able to cover at least an upper portion of a wearer's nasal.

4. A mask maintaining warmth in the nasal area according to claim 3, wherein a metallic wire is provided in the periphery of at least the upper end portion of said nasal area warmth-maintenance portion, and at least said upper end portion being able to be shaped three-dimensionally by means of deforming said metallic wire.

5. A mask maintaining warmth in the nasal area according to claim 4, wherein said metallic wire is provided in the form of a loop around the periphery of said nasal area warmth-maintenance portion.

6. A mask maintaining warmth in the nasal area according to claim 4, wherein said metallic wire is in the form of a flat band.

7. A mask maintaining warmth in the nasal area according to claim 4, wherein said metallic wire is formed from mnematic alloy.

8. A mask maintaining warmth in the nasal area according to one of claims 1 and 2, wherein said nasal area warmth-maintenance portion and said main body are formed separately, at least the upper end portion of the nasal area warmth-maintenance portion being able to be shaped three-dimensionally so as to be able to cover at least an upper portion of a wearer's nasal area, and said nasal area warmth-maintenance portion being connected to said main body at at least one point.

9. A mask maintaining warmth in the nasal area according to claim 8, a lower end portion of said nasal area warmth-maintenance portion being connected to said main body.

10. A mask maintaining warmth in the nasal area according to claim 8, said nasal area warmth-maintenance portion being detachably connected to said main body.

11. A mask maintaining warmth in the nasal area according to one of claims 1 and 2, wherein said nasal area warmth-maintenance portion and said main body are formed unitarily, and at least an upper end portion is pre-formed to a three-dimensional shape to cover at least an upper portion of a wearer's nasal area.

12. A mask maintaining warmth in the nasal area according to one of claims 1 and 2, wherein said nasal area warmth-maintenance portion and said main body are formed separately, at least the upper end portion of said main body being pre-formed into a three-dimensional shape to cover at least an upper portion of a wearer's nasal area, and said nasal warmth-maintenance portion being attached to the main body of at least one point.

13. A mask maintaining warmth in the nasal area according to claim 12, a lower end portion of said nasal area warmth-maintenance portion being connected to said main body.

14. A mask maintaining warmth in the nasal area according to claim 12, said nasal area warmth-maintenance portion being detachably connected to said main body.

15. A mask maintaining warmth in the nasal area according to one of claims 1 and 2, at least said upper end portion of said nasal area warmth-maintenance portion having a skin-colored outer surface.

16. A mask maintaining warmth in the nasal area according to one of claims 1 and 2, at least said nasal area warmth-maintenance portion being formed from at least one of the materials chosen from the group consisting of woven fabric, knit fabric, unwoven fabric, felt, paper, cotton, plastic, foam plastic, rubber, foam rubber, sponge, natural leather, synthetic leather, artificial skin, and metallic foil.

17. mask maintaining warmth in the nasal area according to one of claims 1 and 2, at least said nasal area warmth-maintenance portion being formed from layers of at least two of the materials chosen from the group consisting of woven fabric, knit fabric, unwoven fabric, felt, paper, cotton, plastic, foam plastic, rubber, foam rubber, sponge, natural leather, synthetic leather, artificial skin, and metallic foil.

18. A mask maintaining warmth in the nasal area according to one of claims 1 and 2, wherein at least a portion of said nasal area warmth-maintenance portion is formed from a transparent material.

19. A mask maintaining warmth in the nasal area according to one of claims 1 and 2, at least one material selected from the group consisting of metallic foil, far-infrared radiative material, exothermic material having metallic powder as the main component thereof, exothermic material having calcium oxide as the main component, blood-flow promoters, and magnets, being incorporated into at least said nasal area warmth-maintenance portion.

20. A mask maintaining warmth in the nasal area according to one of claims 1 and 2, wherein an adhesive layer for fixing the nasal area warmth-maintenance portion to a wearer's nasal area is formed on an inner surface of at least the nasal area warmth-maintenance portion.

21. A mask maintaining warmth in the nasal area according to one of claims 1 and 2, wherein a metallic wire is provided in at least the upper portion of the main body.

22. A mask maintaining warmth in the nasal area according to one of claims 1 and 2, wherein a filter layer for collecting allergens is formed in the main body.

23. A mask maintaining warmth in the nasal area according to one of claims 1 and 2, wherein one end of each strap is affixed to the main body, and the other end of each strap is detachably affixed to a side portion of the main body.

24. A mask maintaining warmth in the nasal area according to claim 23, wherein a hook is provided on the other end of said strap, said hook being detachably affixed to any of a plurality of loops provided on a side portion of said main body.

25. A mask maintaining warmth in the nasal area according to one of claims 1 and 2, wherein said nasal area warmth-maintenance portion covers an area surrounding the eyes of a person wearing said mask maintaining warmth in the nasal area.

26. A nasal area warmth maintenance device comprising:

a flexible and warmth-maintaining sheet which covers a wearer's nasal cavity or a wearer's nasal cavity and sinuses but does cover a wearer's nostrils; and an adhesive layer provided over all of one side of said sheet.

27. A mask maintaining warmth in wearer's nasal area comprising:

a main body in the form of a sheet having an upper end portion, a lower end portion, and side portions, said main body being provided with a metallic wire in the form of a loop around the periphery of said main body, said lower end portion being positioned below a wearer's mouth when said mask maintaining warmth in a wearer's nasal area is worn over a human face;

a nasal area warmth-maintenance portion disposed at a central portion of said main body and covering at least a wearer's nasal area when said mask maintaining warmth in a wearer's nasal area is worn over a human face, said nasal area warmth-maintenance portion having an upper end portion for covering at least the upper portion of a wearer's nasal area, said upper end portion being provided so as to protrude from said upper end portion of said main body, said nasal area warmth-maintenance portion for increasing the temperature of at least a portion of a human head; and straps for affixing said main body to a human face, said straps being affixed at first ends thereof to a top of each side portion of said main body and being detachably attached at the other ends thereof on the side portions of said main body, said metallic wire loop providing said main body with rigidity so that a gap is generated between the lower end portion of said main body and a face when the other ends of said straps are attached to an upper half of the side portions of said main body to permit breathing through a wearer's mouth unimpeded by said main body.

28. A mask according to claim 27, wherein the other ends of said straps are attached at the upper half of the side portion of said main body and a gap remains between the lower end portion of said main body and a human face.

* * * * *

UNITED STATES PATENT AND TRADEMARK OFFICE

CERTIFICATE OF CORRECTION

PATENT NO. : 5,727,544

DATED : Mar. 17, 1998

INVENTOR(S) : Miura

It is certified that error appears in the above-identified patent and that said Letters Patent is hereby corrected as shown below:

On title page, "28 Claims" should read —27 Claims—

Column 30, line 11, please delete "Claim 26" in its entirety.

Signed and Sealed this

First Day of December, 1998

*Attest:*

*Attesting Officer*

Bruce Lehman

BRUCE LEHMAN

*Commissioner of Patents and Trademarks*